US008984668B2

(12) United States Patent
Tulin et al.

(10) Patent No.: US 8,984,668 B2
(45) Date of Patent: Mar. 24, 2015

(54) BODY SHAPING FIT SYSTEM

(71) Applicant: Levi Strauss & Co., San Francisco, CA (US)

(72) Inventors: Kris Tulin, El Cerrito, CA (US); Debra Laney, Tularosa, NM (US); Issa Bielefeldt, Vallejo, CA (US)

(73) Assignee: Levi Strauss & Co., San Francisco, CA (US)

( * ) Notice: Subject to any disclaimer, the term of this patent is extended or adjusted under 35 U.S.C. 154(b) by 0 days.

(21) Appl. No.: 13/801,374

(22) Filed: Mar. 13, 2013

(65) Prior Publication Data

US 2014/0068836 A1 Mar. 13, 2014

Related U.S. Application Data

(60) Provisional application No. 61/699,286, filed on Sep. 10, 2012.

(51) Int. Cl.
*A41D 1/08* (2006.01)
*A41D 1/06* (2006.01)

(52) U.S. Cl.
CPC ..... *A41D 1/06* (2013.01); *A41D 2400/38* (2013.01); *A41D 2500/54* (2013.01)
USPC ..... 2/227

(58) Field of Classification Search
CPC ..... A41D 1/06; A41D 1/00; A41D 27/00; A41D 27/06; A41D 31/00; A41D 13/1254; A41D 2400/38; A41D 2400/62; A41D 2300/22
USPC ..... 2/227, 243.1, 241, 255, 258, 260.1, 261
See application file for complete search history.

(56) References Cited

U.S. PATENT DOCUMENTS

| | | | | |
|---|---|---|---|---|
| 5,447,462 | A | 9/1995 | Smith et al. | |
| 5,535,451 | A * | 7/1996 | Tassone et al. | 2/227 |
| 5,537,690 | A | 7/1996 | Johnson | |
| 5,762,535 | A | 6/1998 | Nishiyama et al. | |
| 5,765,224 | A | 6/1998 | Johnson | |
| 5,888,118 | A | 3/1999 | Kishi | |
| 5,968,597 | A * | 10/1999 | Vogt et al. | 427/377 |
| 6,035,448 | A * | 3/2000 | Thomson | 2/227 |
| 6,238,266 | B1 * | 5/2001 | Vogt | 450/19 |

(Continued)

FOREIGN PATENT DOCUMENTS

| | | |
|---|---|---|
| JP | 6033909 U | 5/1994 |
| JP | 7028904 U | 5/1995 |

(Continued)

*Primary Examiner* — Andrew W Collins
(74) *Attorney, Agent, or Firm* — Aka Chan LLP

(57) ABSTRACT

A body shaping fit system for pants is based on the concept of actively shaping the body's silhouette. This fit system includes: a stretch coating formulation for fabric that provides stretch in all directions (e.g., four way stretch) in an engineered way to target specific parts of the body, shape contouring panels, cosmetic finishing techniques, and seaming and construction techniques for pants. In a specific implementation, a pair of jeans includes a shape contouring panel incorporated onto an inside of the jeans, the panel including a polyurethane based coating with holding power to enhance the body's natural curves while de-emphasizing the body's flaws. The fit system is also applicable to pants, shorts, capris, and other clothing where shaping and support is desirable in the waist, seat, hip, and thigh areas.

19 Claims, 16 Drawing Sheets

(56) References Cited

U.S. PATENT DOCUMENTS

| | | | | |
|---|---|---|---|---|
| 6,645,040 | B2 | 11/2003 | Rabinowicz et al. | |
| 6,837,771 | B2 | 1/2005 | Falla | |
| 7,159,621 | B2 * | 1/2007 | Shannon | 139/422 |
| 7,341,500 | B2 * | 3/2008 | Horn et al. | 450/95 |
| 7,682,219 | B2 | 3/2010 | Falla | |
| 7,690,965 | B2 | 4/2010 | Falla et al. | |
| 7,950,069 | B2 | 5/2011 | Lee | |
| 8,418,268 | B2 * | 4/2013 | Waldman et al. | 2/248 |
| 8,621,670 | B2 * | 1/2014 | Hansen | 2/237 |
| 8,732,865 | B2 * | 5/2014 | Ishikawa et al. | 2/227 |
| 8,806,765 | B2 * | 8/2014 | Tulin | 33/17 R |
| 2004/0111781 | A1 | 6/2004 | Miyake et al. | |
| 2007/0214541 | A1 | 9/2007 | Kawasaki et al. | |
| 2008/0034476 | A1 | 2/2008 | MacKinnon | |
| 2009/0181599 | A1 | 7/2009 | Farmer et al. | |
| 2010/0192284 | A1 * | 8/2010 | Simon | 2/236 |
| 2010/0288434 | A1 | 11/2010 | Falla | |
| 2010/0297912 | A1 | 11/2010 | Falla | |
| 2011/0003533 | A1 | 1/2011 | Caruso et al. | |
| 2011/0083246 | A1 | 4/2011 | Vitarana | |
| 2011/0214216 | A1 | 9/2011 | Zarabi | |
| 2011/0230121 | A1 | 9/2011 | Fong | |
| 2011/0302686 | A1 * | 12/2011 | Chapuis | 2/69 |
| 2012/0129425 | A1 * | 5/2012 | Bevans | 450/11 |
| 2013/0095730 | A1 * | 4/2013 | Jensen | 450/95 |
| 2014/0053312 | A1 * | 2/2014 | Nordstrom et al. | 2/69 |

FOREIGN PATENT DOCUMENTS

| | | | |
|---|---|---|---|
| JP | 9031712 | A | 2/1997 |
| JP | 9296305 | A | 11/1997 |
| JP | 2936070 | | 6/1999 |
| JP | 3085783 | | 2/2002 |
| JP | 3097750 | | 8/2003 |
| JP | 2003-535235 | | 11/2003 |
| JP | 3123137 | | 6/2006 |
| JP | 3792204 | B2 | 7/2006 |
| JP | 2009-057660 | A | 3/2009 |
| JP | 2009-511764 | A | 3/2009 |
| JP | 2009-114589 | | 5/2009 |
| JP | 2009-235630 | | 10/2009 |
| JP | 2010-042097 | A | 2/2010 |
| JP | 2010-095803 | | 4/2010 |
| JP | 4526226 | B2 | 8/2010 |
| JP | 2011-001671 | | 1/2011 |
| JP | 4861073 | B2 | 1/2012 |
| WO | 9958007 | A1 | 11/1999 |

* cited by examiner

GIRTH POINTS OF MEASURE

BODY SHAPING FIT SYSTEM

CROSS-REFERENCE TO RELATED APPLICATIONS

This patent application claims the benefit of U.S. patent application 61/699,286, filed Sep. 10, 2012, which is incorporated by reference along with all other references cited in this application.

BACKGROUND OF THE INVENTION

The present invention relates to clothing sizing systems and, more specifically, to pants, especially jeans, having a body shaping fit that actively shapes the wearer's body.

In 1853, during the California Gold Rush, Levi Strauss, a 24-year-old German immigrant, left New York for San Francisco with a small supply of dry goods with the intention of opening a branch of his brother's New York dry goods business. Shortly after arriving in San Francisco, Mr. Strauss realized that the miners and prospectors (called the "forty niners") needed pants strong enough to last through the hard work conditions they endured. So, Mr. Strauss developed the now familiar jeans which he sold to the miners. The company he founded, Levi Strauss & Co., still sells jeans and is the most widely known jeans brand in the world. Levi's is a trademark of Levi Strauss & Co.

Though jeans at the time of the Gold Rush were used as work clothes (which were relatively loose fitting since fashion was not a concern), jeans have evolved to be fashionably worn everyday by men and women, showing up on billboards, television commercials, and fashion runways. Fashion is one of the largest consumer industries in the U.S. and around the world. Jeans and related apparel are a significant segment of the industry.

As fashion, people want their jeans to have a customized fit (e.g., "tight fitting jeans"). Good fitting jeans today have a form fit that is very different than, for example, the pants of the 1800s and early 1900s. Before, loose-fit or overly baggy pants and balloon dresses were the norm, since they were intended to hide or obscure the body shape. Today, modern technology has allowed the manufacture of off-the-rack pants, jeans, and shorts having much better form fit, while at the same time being comfortable to wear.

Despite the widespread success jeans have enjoyed, there is a continuing desire to address the demands of the consumer even better. Consumers desire off-the-rack, form-fitting jeans for their own seat and hip shapes, without having to pay for custom tailoring. Existing jeans sizing systems, which may have addressed the market demand of the time they were developed, do not adequately address the demand of the modern consumer and their wide variety of body shapes.

People want their jeans to have a tight, form fitting look, where the jeans conform to the shape of the body. Furthermore, consumers want form flattering jeans that molds and shapes the body's natural silhouette, while flattering the body's natural curves.

Therefore, there is a need for a new shaping system for jeans and similar clothing (e.g., pants, shorts, and skirts) that provide consumers with jeans that make them look good.

BRIEF SUMMARY OF THE INVENTION

A new body shaping fit system for pants is based on the concept of actively shaping the body's silhouette. This fit system is based upon a combination of one or more unique design and engineering components including: a stretch coating formulation for fabric that provides stretch in all directions (e.g., four way stretch) in an engineered way to target specific areas of a consumer's body, shape contouring panels, cosmetic finishing techniques, and seaming and construction techniques. The fit system provides a consumer with a form fitting pair of jeans with holding power to enhance the body's natural curves while de-emphasizing the body's flaws. The fit system is also applicable to pants, shorts, skirts, and other clothing where form fit and support is desirable in the seat, hip, and thigh areas.

A specific implementation of the fit system of the invention works with the Levi's Curve ID® system. Curve ID is a registered trademark of Levi Strauss & Co. Curve ID allows women to find the perfect fit based on body type. Curve ID specifically addresses women's body shapes with its basic body shape categories: e.g., slight curve, demi curve, and bold curve. Optionally, Curve ID includes a fourth custom fit, which is called the supreme curve. This Curve ID formula for finding the perfect fit looks beyond waist size to address the true curves of a woman's body.

To use the Curve ID system, the consumer finds their shape using a shape measuring tool. The shape measuring tool calculates a shape category based on a differential of two measurements in the seat area. With this shape category information, the consumer can easily locate a pair of form-fitting jeans. The Curve ID system is described in U.S. Pat. No. 8,307,560, issued Nov. 13, 2012 (U.S. patent application Ser. No. 12/917,887, filed Nov. 2, 2010), assigned to Levi Strauss & Co., and this patent is incorporated by reference.

The system of the invention is not limited to a single manufacturer or brand of jeans nor is it necessary that the system be used for or with another fit system (e.g., Curve ID). The system can be used to create a single garment or a collection of garments. In addition, specific elements, methods, and techniques of the system can be used alone or in combination, and can be applied to other garments, or collections of garments made by other manufacturers.

A specific implementation of the fit system of the invention is the Levi's Revel™ system. Revel is a trademark of Levi Strauss & Co. After determining the body shape category and a particular size within that category using the Curve ID system, a female consumer will try on a pair of jeans. Through the Revel system, the jeans are specifically engineered and designed for the consumer's body shape. The jeans provide support (e.g., holding power) for the woman's seat, hip and thigh areas by incorporating unique shape contouring panels that are made through a unique screen printing process on the inside surface of the jeans. The unique engineering and placement of the panels inside the jeans can smooth and hold in the stomach, seat and inner and outer thighs, while lifting up the seat. In addition, the finish of the jeans is specifically designed for the woman's body shape. Specific design techniques like placement of shading, placement of abrasion patterns, positioning of whiskers, and seam and stitch detail can create an illusion of longer, leaner thighs, a lifted seat, and flattering curves at the hip and seat. Although Revel specifically addresses fit for women, aspects of the system can be applied to other classes of consumers, including men, children, teens, boys, and girls.

In an implementation, a method includes: mixing a solution for a coating mixture; providing a pattern of a shape contouring panel; creating a screen incorporating the pattern; printing the pattern onto fabric; curing the fabric with the printed pattern; cutting the fabric according to a garment pattern; forming a garment from the garment pattern; and applying cosmetic finishing, seam, and construction detailing to the garment.

In an implementation, a method of producing a shape contouring panel includes: creating a screen having a pattern of the shape contouring panel; screen printing the pattern onto a substrate including placing the screen over the substrate; applying a coating mixture to the screen; applying pressure to the screen and removing the screen; and drying (or curing) the fabric. The process can be manually completed, automated, or semi-automated.

In an implementation, a method of applying cosmetic finishing to pants includes: adding highlights to a narrow portion of the front thigh; adding low light shading to an inner and outer portion of the thigh; adding whiskers to the front of the pants; and adding an abrasion portion to the back of the pants, along the seat.

In an implementation, a pair of jeans includes: at least one inside shape contouring panel, the panel including a polyurethane based coating; low light shading along an inner thigh area and an outer thigh area on the outside of the jeans; highlighting on a front area of the thigh; and highlighting on a back of the jeans along the seat area.

In an implementation, a pants includes a denim material sewn into pants, where the denim material has a first stretch characteristic; and a polyurethane coating, applied to a portion of an inside of the denim material in an upper thigh region of the pants and avoiding a buttocks region, where the denim material with the polyurethane coating has a second stretch characteristic which is less elastic than the first stretch characteristic, and the polyurethane coating is not visible from an exterior of the pants.

In an implementation, a method includes: mixing a solution for a coating mixture for a shape contouring panel; creating the shape contouring panel on fabric; cutting and forming the fabric according to a pattern for a garment; and adding a cosmetic finishing detail to the garment.

In an implementation, a body shaping panel positioned on an inside surface of a thigh portion of pants includes: a first edge extending along an outer thigh of the pants, from about a hip area down to a mid-thigh area; a second edge extending along an inner thigh, where a length of the second edge is shorter than a length of the first edge; a third edge extending from the hip area down to a crotch area; and a fourth edge that wraps around a portion of the outer mid-thigh of the pants and curves up to the inner thigh.

Other objects, features, and advantages of the present invention will become apparent upon consideration of the following detailed description and the accompanying drawings, in which like reference designations represent like features throughout the figures.

BRIEF DESCRIPTION OF THE DRAWINGS

FIG. 11A shows an example of jeans having a slight curve. FIG. 11B shows an example of jeans having a demi curve. FIG. 11C shows an example of jeans having a bold curve.

FIG. 12A shows an example of jeans having a slight curve. FIG. 12B shows an example of jeans having a demi curve. FIG. 12C shows an example of jeans having a bold curve.

DETAILED DESCRIPTION OF THE INVENTION

Many people have difficulty finding form fitting jeans that flatter their body shape and help define their silhouette. Form fitting jeans can actually appear to be too tight in some areas, and too loose in others. A problem with tight jeans is that they do not offer support for the wearer's body to hold in and smooth out certain areas that need added support. Consumers generally indicate these problematic areas to be the stomach, hips, seat, and thighs. After repeated wear, what were once tight-fitting jeans can noticeably begin to stretch, sag, and wear in the fabric around these areas of the body. As a result, the jeans can actually emphasize flawed areas of the body rather than flattering the natural curves and shape of the wearer. Jeans manufacturers do not take into consideration the need to provide increased support for these body areas.

To address these shortcomings, this patent introduces a new body shaping fit system for garments including for example, pants, shorts, active wear, underwear, and shape wear. Although the system is discussed with respect to pants, jeans, capris, and shorts, the system can also be applied to other types of shaped fit clothing, especially those worn, at least in part, at and below the waist. These include skorts (combination of shorts and a skirt), slacks, formal wear (e.g., tuxedo trousers), school uniforms, military wear, athletic wear, sportswear (e.g., cycling wear, ski wear, golf wear, martial arts wear, track and field wear, swim wear, gymnastics wear, softball uniforms, baseball uniforms, football uniforms, hockey uniforms, lacrosse uniforms, winter and summer Olympics team apparel, gym wear, and others), dance wear, lingerie, panties, boxers, briefs, corsets, costumes (e.g., Halloween costumes or masquerade ball), compression wear, and many others.

Figure 1B:
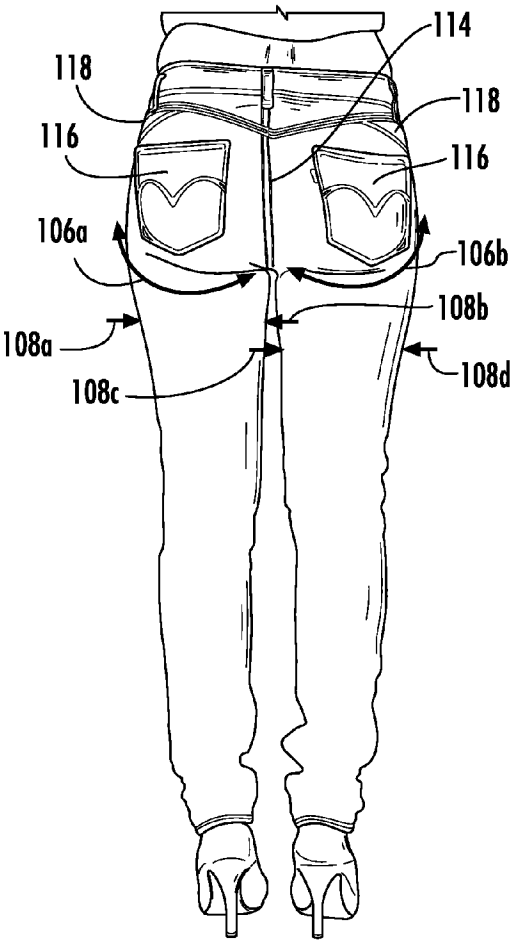
FIG. 1B shows a back view of a woman's body indicating specific body areas that need support and shaping.
Figure 1A:
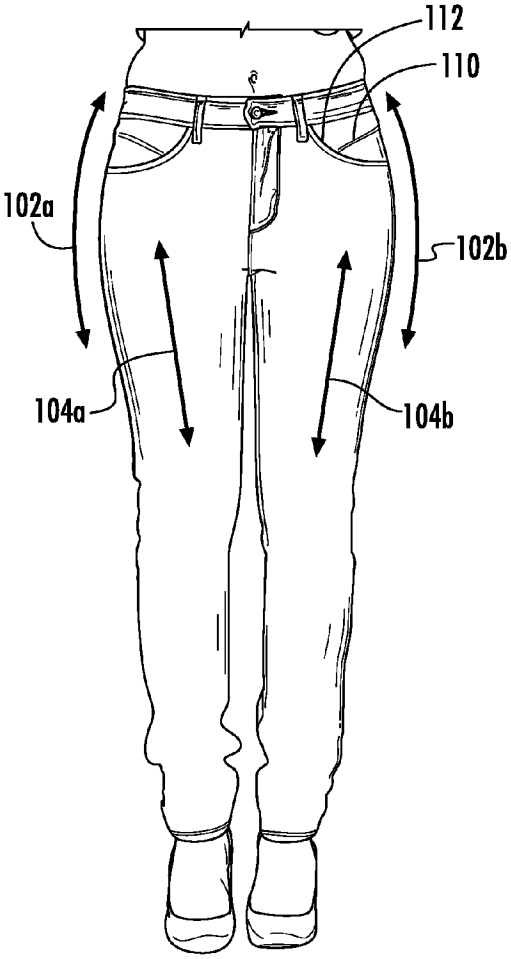
FIG. 1A shows a front view of a woman's body indicating specific body areas that need support and shaping.

FIGS. 1A and 1B show views of specific body areas of a wearer that need support and shaping. FIG. 1A shows a front view of the wearer's body. Women want an attractive, feminine shape when wearing jeans. Women want to look like their hips 102*a* and 102*b* are smoothed out and held in. They want to hide any bulge of the hips, while accentuating the natural curves of the hips. A flattened stomach is another desirable feature that women often look for in a pair of jeans. Along the thighs 104*a* and 104*b*, women want a long, lean appearance, to look like their legs are slimmer.

FIG. 1B shows a back view of the wearer's body. The seat 106*a* and 106*b* is an area that can be problematic for many women. Women want to look like their seat is lifted and curvaceous when wearing jeans. Slimmer women who are less curvy may want a pair of jeans to accentuate their natural curves in the seat area. On the other hand, more curvaceous women with wider hips and a rounder seat may want jeans that hold in and support these areas, while hiding bulges. Further, a slim looking thigh, around the inner thighs 108*b* and 108*c* and outer thighs 108*a* and 108*d*, is another desirable look.

A specific implementation of the body shaping fit system works with the Levi's Curve ID® system. Curve ID is a registered trademark of Levi Strauss & Co. Curve ID specifically addresses women's body shapes with its body shape categories: e.g., slight curve (straighter figure, flatter fanny), demi curve (evenly proportioned hip and seat) and bold curve (smaller waist, larger seat). The slight curve fit is for relatively straight figures. The fit defines a woman's waist, while accentuating her curves. The demi curve fit is for evenly proportioned women. This fit is designed to flatter a woman's waist while smoothing her shape. The bold curve fit is for curvy women. The bold curve fit hugs the woman's waist without gaping or pulling. Optionally, Curve ID includes a fourth custom fit, which is called the supreme curve.

To use the Curve ID system, a woman finds her shape using a shape measuring tool. The shape measuring tool calculates a shape category based on a differential of two measurements in the hip area. With this shape category information, the woman can easily locate a pair of form-fitting jeans.

A specific implementation of the body shaping fit system of the invention is the Levi's Revel system. Revel extends beyond the Curve ID fit sizing system by providing a new fit system of jeans that actively shape a woman's body. In the Revel system, jeans are specifically engineered and designed for the woman's body shape. The jeans provide support (e.g., holding power) for the woman's seat, hip and thigh areas by incorporating unique shape contouring panels that are made through a unique printing process on the inside surface of the jeans. The unique engineering and positioning of the panels inside the jeans can smooth and hold the stomach, seat and inner and outer thighs, while lifting the seat. A more detailed discussion of the Curve ID system is described below in the discussion for FIGS. 13-16.

In addition, the finish of the jeans is specifically designed for the woman's body shape. Specific design techniques like placement of shading, placement of abrasion patterns, positioning of whiskers, seam and stitch detail can create an illusion of longer, leaner thighs, a lifted seat, and flattering curves at the hip and seat.

Revel system jeans are provided for each shape category of Curve ID, in a variety of styles, sizes, colors, rinses, finishes, and embellishments. For example, styles can include skinny leg, straight leg, boot cut, wide leg, flare, trouser cut, boyfriend cut, low rise, high rise, and many others. Colors can include blue, black, indigo, white, and any other color. In a specific implementation, a skinny cut and a straight cut style of jeans will be offered in each shape category of Curve ID. For each style of jean, there are various sizes, colors, rinses (e.g., indigo, red, purple, black, and others), and embellishments (e.g., contemporary, progressive, and others) available. In other implementations, any combination of style, size, color, rinse, finish, and embellishment can be used for jeans in the Revel system.

Figure 2:
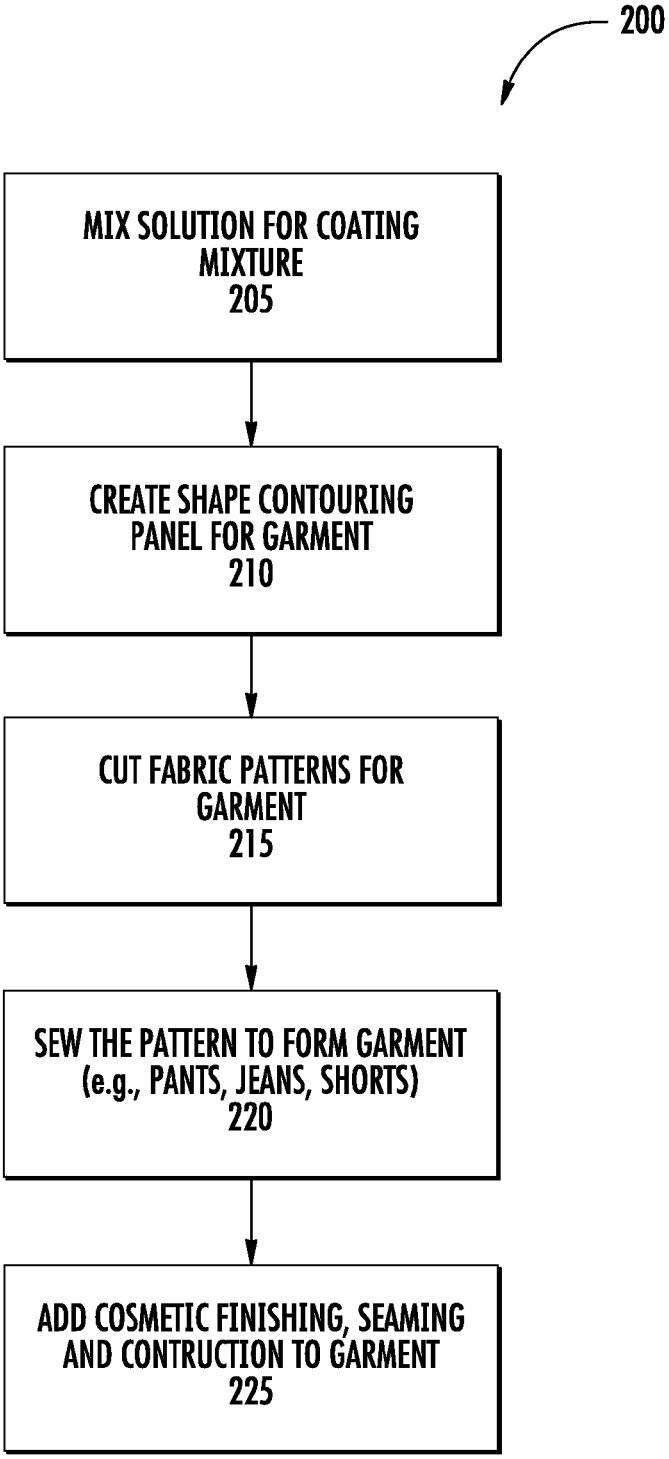
FIG. 2 shows a flow diagram for a body shaping fit system for a garment. The system is applicable to pants, shorts, and other types of shaped fit clothing, especially those worn, at least in part, at and below the waist.

FIG. 2 shows a flow diagram for the body shaping fit system for a garment. The system has components to generate a garment or a collection of garments that actively shapes a person's body shape to accentuate the natural curves while de-emphasizing any flaws. Components include: mixing a solution for a coating mixture for a shape contouring panel 205, creating the shape contouring panel on fabric (e.g., natural and synthetic fabric) 210, cutting the fabric according to a pattern for a garment 215, forming the pattern into a garment 220, and adding cosmetic finishing details to the garment 225.

Figure 3A:
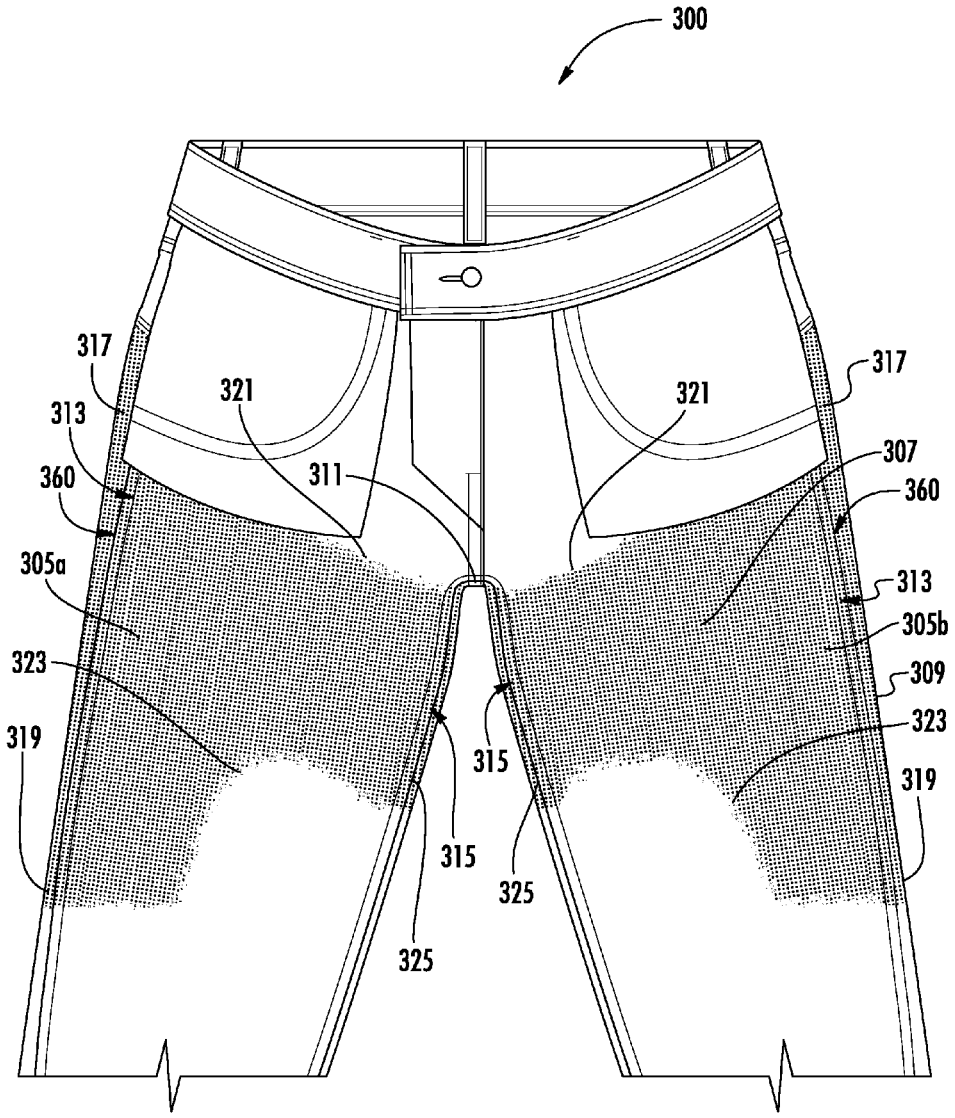
FIG. 3A shows a front view of a specific implementation of a shape contouring panel incorporated in a pair of jeans.
Figure 3B:
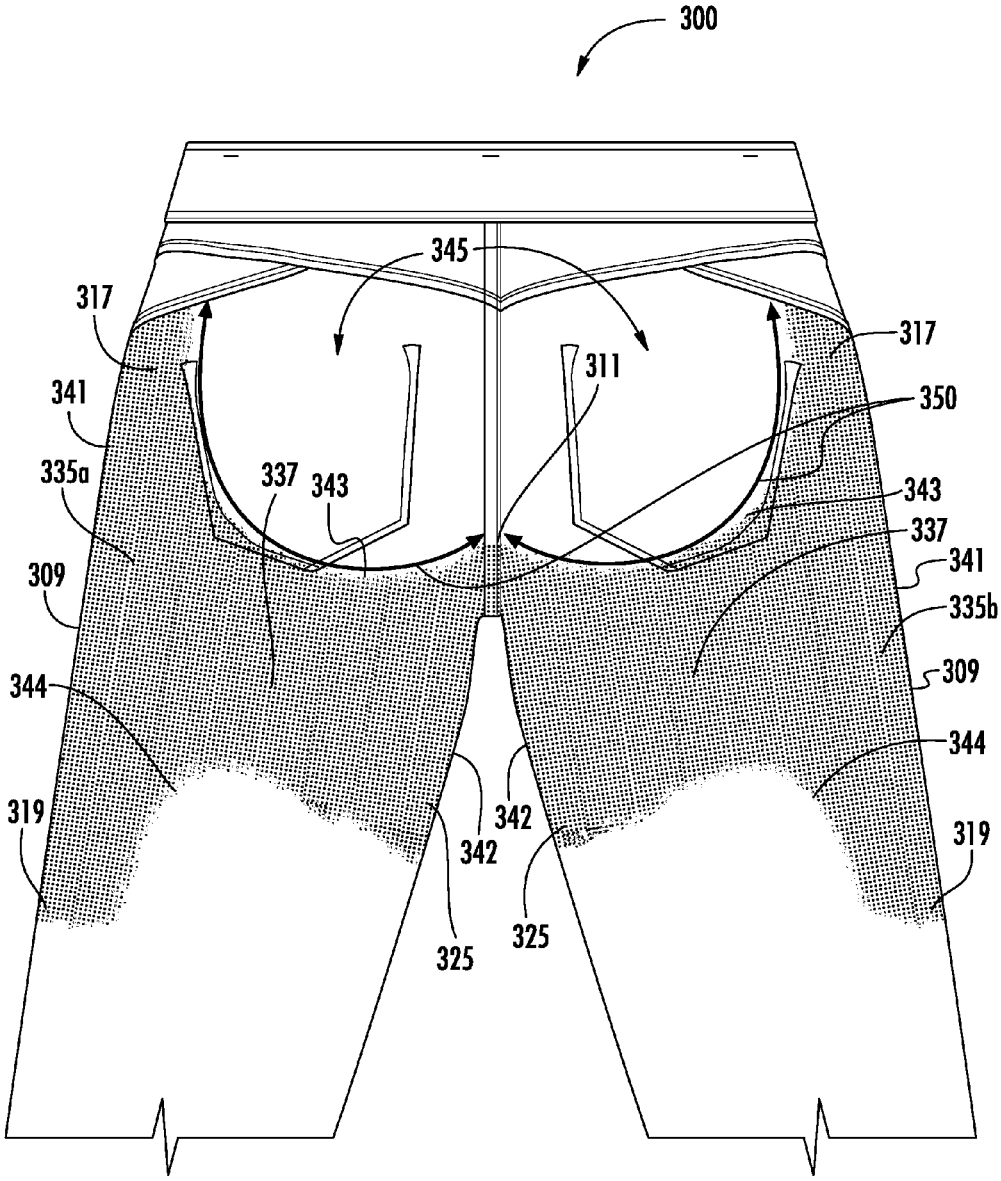
FIG. 3B shows a back view of a specific implementation of a shape contouring panel of coating on an inside incorporated in a pair of jeans.

The shape contouring panel is engineered to be incorporated in various positions of a garment to target specific areas of the body. The panel includes a liquid coating mixture that is applied (e.g., screen printed, sprayed, painted, brushed, adhered to or otherwise deposited) to an inside surface of a garment. FIGS. 3A and 3B show a specific implementation of the shape contouring panel incorporated in a pair of jeans.

Creating the panel includes applying a liquid coating of a compound onto fabric. The compound has a different stretch factor than that of the fabric, and when incorporated into the fabric, changes the stretch properties of the fabric in the areas to which it has been applied. The compound is applied to one or more areas of the fabric, and can be shaped according to a predetermined pattern (to yield a panel of a specific shape and design) or applied to random areas of the fabric without using a pattern. In some implementations, the compound is applied to the entire surface of a piece of fabric. The fabric having the incorporated compound can be used to create a garment.

The shape contouring panel is not visible from the outside of the finished garment. The compound is applied to an inner surface of the garment and configured to contact the body of the wearer at various positions. From the outside of the garment, edge lines of the panels are not noticeable. As will be explained below, the panels have smooth transitions and do not create unsightly visible lines in the fabric of the garment when the garment is worn by the wearer.

Figure 4:
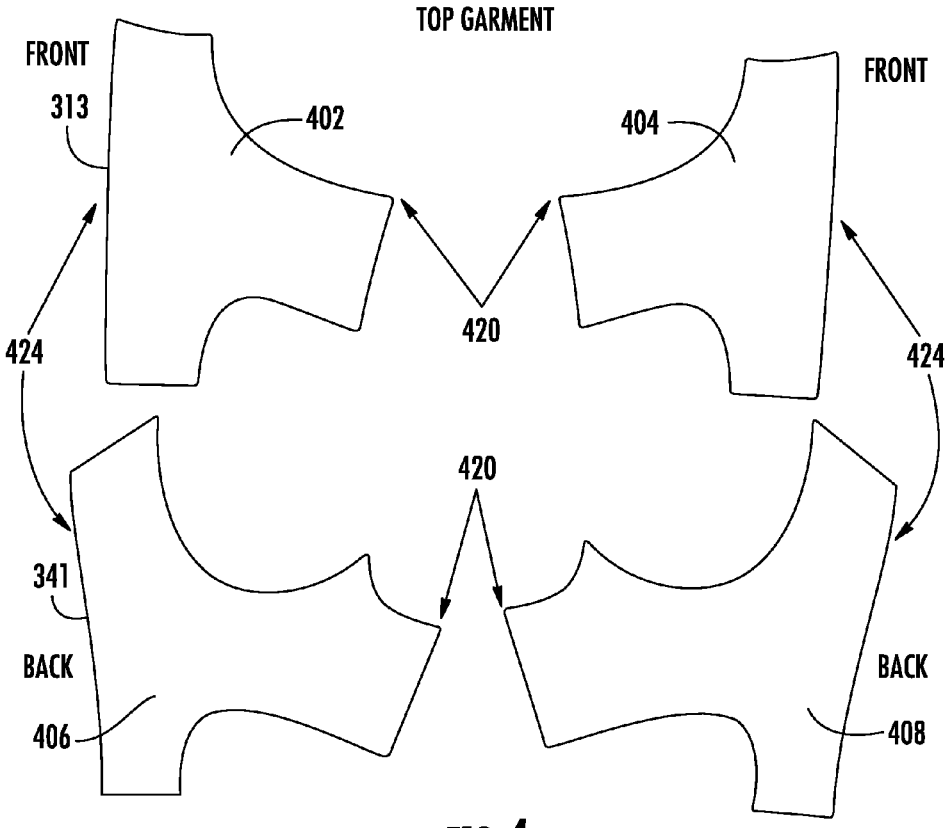
FIG. 4 shows a specific implementation of patterns for shape contouring panels that are shaped for a pair of pants.

FIG. 4 shows a specific implementation of patterns for shape contouring panels that are shaped for a pair of pants. There are four panels, each of which is applied to a different area of an interior surface of the pants. The top left panel 402 and right panel 404 are applied to a front inside surface of the pants, as shown in FIG. 3A. The bottom left panel 406 and right panel 408 are applied to a back inside surface of the pants, as shown in FIG. 3B. In a finished pair of pants, as discussed below for FIG. 5, the front panels and back panels meet at a crotch point 420. The first edge 313 of panel 402 and the first edge 341 of panel 406 can be joined to form a side seam 424 of the pants on the right side of the pants, the left side, or both.

Referring back to FIG. 3A, it shows an example of the placement of the front panels 305*a* and 305*b* on an inside surface of a pair of jeans 300. The front panels wrap around a portion of the front of the upper thigh 307 to the outer side of the thigh 309. The two front panels are joined at a crotch seam 311. A first edge 313 of the panel is longer than an opposite second edge 315. The first edge extends along the outer thigh of a wearer, from about the hip area 317 down to mid-thigh area 319. A third edge 321 curves from the hip area down to the crotch. A fourth edge 323 wraps around a portion of the outer mid-thigh of the wearer and curves up to the inner thigh 325. The shape and dimensions of the front panel can be modified or altered as appropriate for a particular application or based on the particular garment or situation. In the implementation shown in FIG. 3A, the front panel is designed to smooth and support the hip and outer thigh, as well as a portion of the inner thigh.

FIG. 3B shows an example of the placement of the back panels 335*a* and 335*b* on an inside surface of a pair of jeans. The back panels wrap around a portion of the back of the upper thigh 337 to the outer side of the thigh 309. The two back panels are joined at the crotch seam 311. A first edge 341 of the panel is longer than an opposite second edge 342. The first edge extends along the outer thigh of a wearer, from about the hip area 317 down to mid-thigh area 319. A third edge 343 curves around the seat 345 from the hip area 317 down to the crotch area. A fourth edge 344 wraps around a portion of the outer mid-thigh of the wearer and curves up to the inner thigh 325. The shape and dimensions of the back panel can be modified or altered as appropriate for a particular application or based on the particular garment or situation.

In this implementation, the back panel is designed to smooth and support the hip and outer thigh, as well as a portion of the inner thigh. Further, the third edge is designed to lift the seat of the wearer as it curves around and cups the natural curve 350 of the seat. The third edge of the right side of the jeans the third edge of the left side of the jeans meet along a crotch seam. These two edges can form a heart shape as shown in FIG. 3B, or any other shape (e.g., U-shape).

In a specific implementation, a body shaping panel positioned on an inside surface of a thigh portion (reference number 307 in FIG. 3A and reference number 337 in FIG. 3B) of pants includes a first edge (reference number 313 in FIG. 3A and reference number 341 in FIG. 3B) extending along an outer thigh 309 of the pants, from about a hip area 317 down to a mid-thigh area 319, a second edge (reference number 315 in FIG. 3A and reference number 342 in FIG. 3B) extending along an inner thigh 325, where a length of the second edge is shorter than a length of the first edge, a third edge (reference number 321 in FIG. 3A and reference number 343 in FIG. 3B) extending from the hip area down to a crotch area 311; and a fourth edge (reference number 323 in FIG. 3A and reference number 344 in FIG. 3B) that wraps around a portion of the outer mid-thigh 337 of the pants and curves up to the inner thigh.

Figure 5:
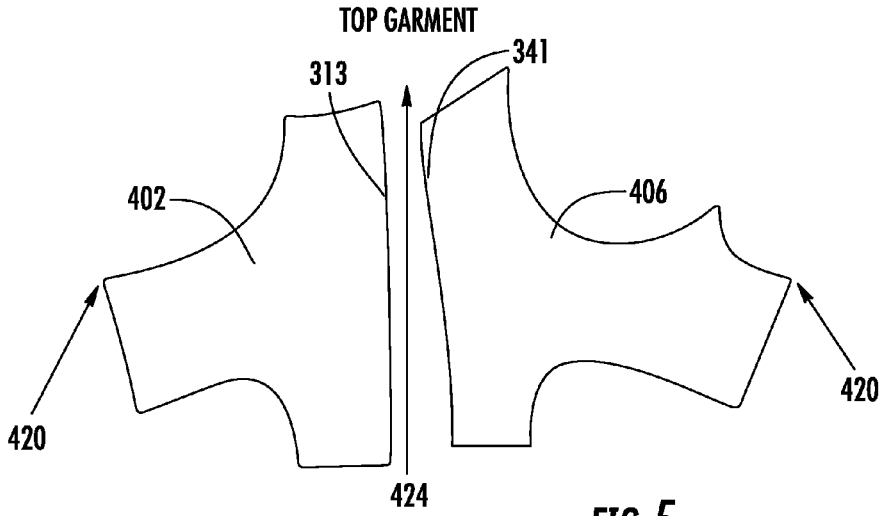
FIG. 5 shows a specific implementation of the panels where the panels are joined together to form the pants.

FIG. 5 shows a specific implementation of panels 402 and 406 where the panels are joined together to form the pants. The first edge 313 of front panel 402 and the first edge 341 of the back panel 406 can be joined to form a side seam 424 of the pants on the right side of the pants, the left side, or both. In the finished pair of pants, the front panels and back panels meet at a crotch point 420. It is not necessary that the pants have all four panels incorporated or joined in this manner in a single garment. In other implementations, the pants can have any combination of front and back panels incorporated in the finished garment. For example, a pair of jeans can have a single panel (front or back), two front panels, two back panels, or a front and a back panel only. The panel or panels can be placed in any position on the inside of the pants, depending on the particular application or based on the particular garment or situation.

For a collection of garments where there are different sizes for a type of garment (e.g., increasing sizes of jeans starting from size 0 to size 24, or from waist size 23 to size 34, or increasing sizes of athletic shorts from size extra-small to size extra-large) the size of the panels can increase with the size of the garment. This increase in size can be proportional to the increase in size of the garment, but can also be non-proportional. A panel of a specific size and shape can be used for a specific size garment or for more than one size garment. For example, the same size and shape panel can be used in both a size 2 and a size 4 pair of jeans, while a large size and shape panel is used in a size 6 jean, and an even larger panel is used in both a size 8 and a size 10 jean. In other implementations, the size and shape of the panel need not change and can be used in each garment of a whole collection of garments.

In a specific implementation, where the Levi's Revel system is used as an extension to the Curve ID system, there are different size panels for different sizes of jeans within each shape category. For example, there can be a set of patterns (i.e., templates) of increasing dimensions that is used for creating the panels on jeans of increasing size in the demi curve shape category. In a specific implementation, a set includes 8 to 12 patterns of increasing dimension for each category. A pattern can be used for two consecutive sizes. For example, the smallest pattern in a set can be used to create a waist size 23 jean and a size 24 jean. In other implementations, each size of jean can have a different size panel, or for at least two sizes of jeans, the same size panel can be used.

The panel includes a coating (e.g., film or layer) of a compound (e.g., liquid compound having specific stretch properties when dry or cured) that is applied to the fabric of the garment. The compound has a different stretch factor than that of the fabric when the compound is dried, and when incorporated into the fabric, changes the stretch properties of the fabric in the areas to which it has been applied.

In implementations, once applied to the fabric, the panel limits the natural stretch of the fabric. The compound has a lower stretch factor than that of the fabric (i.e., the stretch is more limited, less elastic). These areas of the garment with panels having less stretch (lower elasticity) can provide firm support for the wearer in the areas where the panels are positioned (e.g., below the curve of the seat, inner and outer thighs). This coating can regulate the level of stretch in predetermined areas of the garment. As a result, the panels can be positioned in targeted areas on the garment to shape the wearer's body. For example, shape contouring panels in a pair of jeans can actively shape a wearer's lower body to look like the wearer has longer, leaner thighs, a lifted seat, and a flat stomach. In other implementations, the compound of the panel can have about the same stretch factor as that of the fabric or have a higher stretch factor.

In a specific implementation, a pair of pants include a denim material sewn into pants, wherein the denim material has a first stretch characteristic, and a polyurethane coating, applied to a portion of an inside of the denim material in an upper thigh region (see reference numbers 307 and 337 in FIG. 3B) of the pants and avoiding a buttocks region (see reference numbers 345, 350, and 343 in FIG. 3B). The denim material with the polyurethane coating has a second stretch characteristic which is less elastic than the first stretch characteristic. The polyurethane coating is not visible from an exterior of the pants.

In an implementation, the incorporated panel provides an engineered bi-stretch effect to the fabric, in which the coated fabric can stretch in all directions in an engineered way to target specific areas of the consumer's body. This allows the panels to mold and shape to the natural curves of the wearer's body. In other implementations, depending on the compound used and the placement of the panel on the garment, the panel can stretch along a certain direction but not in other directions.

The incorporated panel has a smooth hand feel. The coating is lightweight, and provides the wearer with lasting comfort. In addition, the panels can stretch and recover with the wearer's body as the wearer moves, so that the pants do not feel restrictive against the body.

In implementations, the compound for the coating is a mixture of different compounds. In other implementations, the compound is a single compound. In some implementations, the mixture includes a polyurethane (PU) compound that is applied (e.g., sprayed, printed, brushed, painted, or otherwise deposited) onto fabric. PU compounds are flexible and lightweight yet durable once applied to fabric. In other implementations, other types of PU and synthetic compounds can be used in the coating mixture. For example, these can include plastisol, polyethylene, water-based coatings, polypropylene, thermoplastics, and many others.

The PU compound can be used as a coating or finish for textile fabrics. Polyurethane is resistant to wear and cracking, and can bend and move with the fabric once it has been applied. Once applied to fabric, it can limit the stretch of the fabric. In implementations, the fabric is a woven cotton fabric (e.g., denim, twill, khaki, linen, or corduroy), or a cotton blend fabric (e.g., cotton blended with Lycra, polyester, acrylic, nylon, acetate, viscose, and triacetate). In other implementations, the fabric can be any natural fiber textile (e.g., wool, or silk), synthetic fabric or a combination of these.

The PU compound can be mixed with other compounds to form the coating mixture. Other compounds include resins, emulsifiers, thickening agents, and many others. The mixture can further include colored dyes so that the finished panels have a different color than fabric onto which it is applied.

In a specific implementation, the mixture includes a combination of polyurethane, a cross linking agent, an emulsifier, a blue dye, a black dye, and a thickener. The cross linking agent is a resin that acts as a cross linker for other compounds such as paints, inks, adhesives and coatings. It can cross link dispersions and emulsions at ambient and elevated temperatures. An emulsifier is used in printing processes. Dyes can be used for textile printing. In a specific implementation, the dye is a navy shade. Another dye for textile printing with a bluish black color can be used. The thickener is a synthetic thickener for liquids and coating pastes. In other implementations, other compounds can be substituted for or replace any of the one or more compounds described above.

In an implementation, the mixture is a specific formulation of an amount of each compound. In a specific implementation, the mixture includes 30-70 percent polyurethane, 1-5 percent cross linking agent, 10-20 grams per liter (or equivalent percentage) of emulsifier, 1-2 grams per liter (or equivalent percentage) of a blue dye, 0.5-1.5 grams per liter (or equivalent percentage) of a black dye, and 10-20 grams (or equivalent percentage) of a thickener. The range of specific percentages presented can be in percentage by volume or percentage by weight, depending on the particular application or based on the data or situation.

It should be understood that the invention is not limited to the specific percentages presented. A formulation of the invention may have additional compounds (not necessarily described in this application), different compounds which replace some of the compounds presented, fewer of the compounds presented, or any combination of these. Further, the compounds in other implementations of the invention may not be exactly the same as the compounds presented and may be modified or altered as appropriate for a particular application or based on the data or situation. For example, in other implementations, other PU compounds and other resins, emulsifiers, thickeners, dyes, and others can be used in any combination for the coating.

Referring back to FIG. 2, the shape contouring panel is created. This step can be processed before, during, or after the mixture solution for the coating is mixed.

Figure 6:
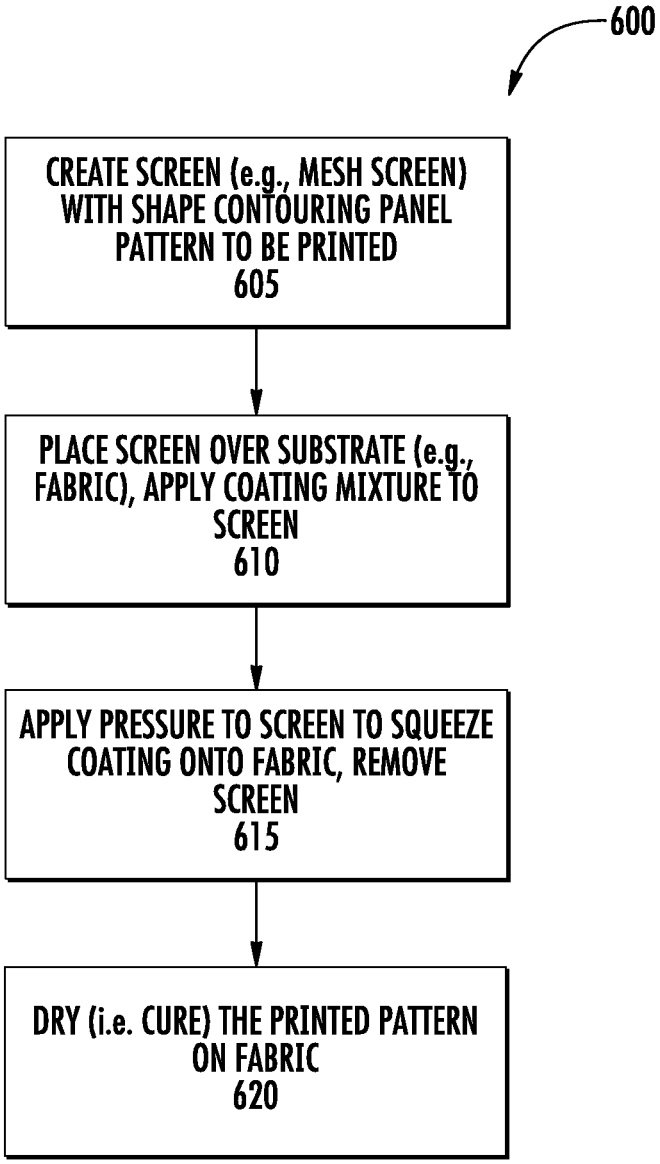
FIG. 6 shows a method of creating a shape contouring panel for a garment.

FIG. 6 shows a flow diagram of a specific implementation for creating the panel. The flow includes the components: creating a screen (e.g., using a mesh screen) with a pattern of a shape contouring panel in preparation for printing 605, placing the screen over a substrate (e.g., fabric) and applying the a coating mixture to the screen 610, applying pressure to the screen to squeeze the coating onto the fabric and removing the screen 615, and allowing the printed pattern of the panel to dry (or cure) on the fabric 620.

In a specific implementation, a method includes mixing a solution for a coating mixture for a shape contouring panel, creating the shape contouring panel on fabric, cutting and forming the fabric according to a pattern for a garment; and adding a cosmetic finishing detail to the garment.

Figure 7:
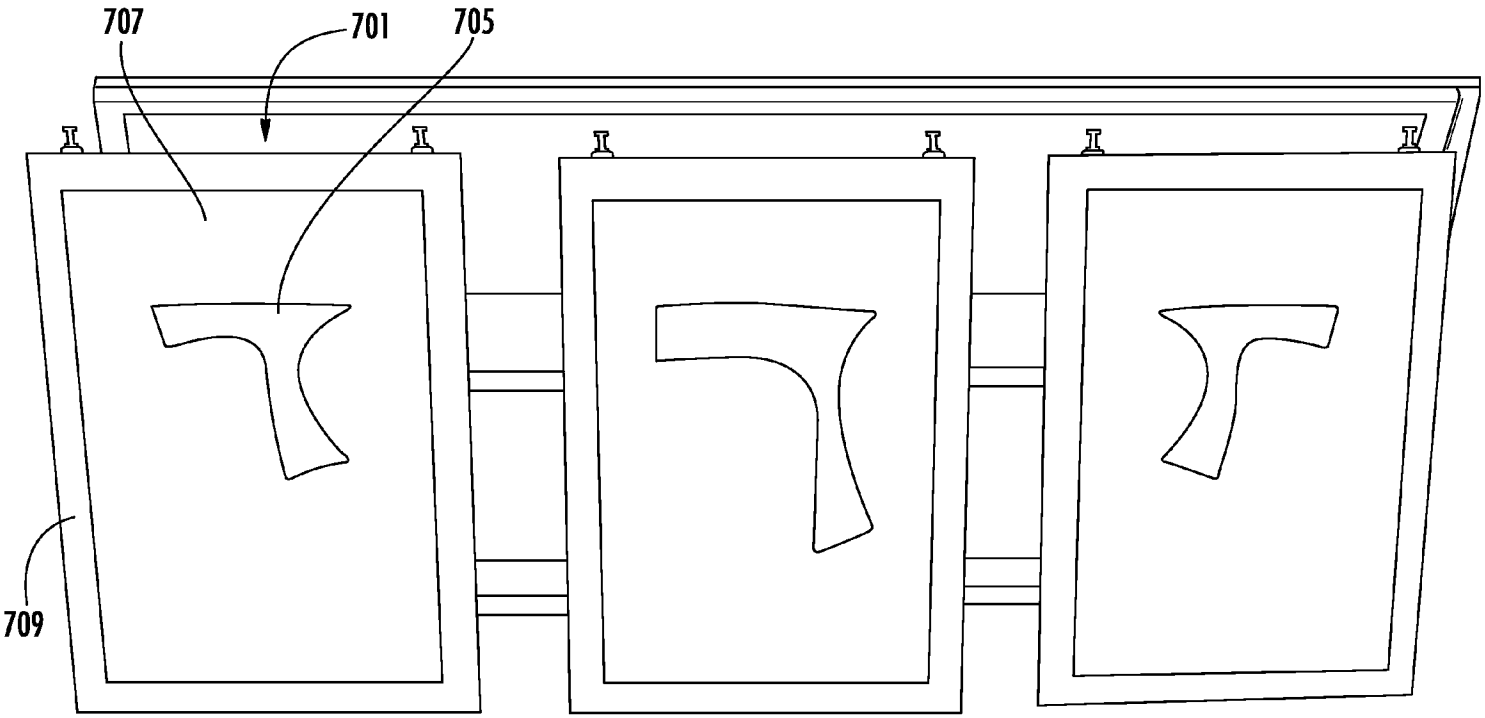
FIG. 7 shows a specific implementation of screens with various patterns for shape contouring panels.

FIG. 7 shows a specific implementation of screens with various patterns of panels. The panel can be made from a screen printing (i.e., silkscreen printing) process in which a pattern 705 of the panel is formed on a screen 701. The screen can be prepared using a mesh screen 707 that is stretched over a frame 709. Other types of porous materials (e.g., any woven fabric, nylon, polyester, steel, and many others) can also be used in the process. A stencil of the pattern can be formed by applying an emulsion to the screen, and blocking off parts of the screen in the negative image of the pattern (e.g., using a stencil, a cutout, or transfer paper). The screen can undergo a pre-press process in which the shape of the pattern is burned into the screen. Many other pre-printing processes used in screen printing can be incorporated prior to printing.

A bar (e.g., fill bar or floodbar) is dragged across the screen and used to push the coating mixture into the openings of the mesh. The bar starts at one end of the screen and is moved to an opposite end with a slight downward force. During this, the actual screen is lifted a bit off the garment to avoid contact. A blade (e.g., a rubber squeegee) is then used to move the mesh down to the printing surface of the fabric. The ink that is in the mesh opening is pumped or squeezed by capillary action to the fabric in a controlled and prescribed amount (i.e. the amount of coating mixture deposited is proportional to the thickness of the mesh and stencil). As the squeegee moves toward the rear of the screen, the tension of the mesh pulls the mesh up away from the fabric, leaving the coating mixture upon the surface of the fabric.

The screen printing can be completed through a manual, automatic, or semi-automatic process. There are semi-automatic and automatic screen printing machines that are commercially available. In a specific implementation, an automated process of printing a panel onto fabric includes using a mesh screen having opening size of about 43-60 micrometers, applying the coating mixture to the screen, stroking the screen 2-4 times by a bar of the printing machine, at a pressure of 2-4 bars of air pressure.

The process further includes curing (or drying) the fabric having the printed panel. In specific implementations, the curing is completed through an automated process at about 100 degrees Celsius to about 175 degrees Celsius, from about 1 minute to about 10 minutes.

This description of the screen printing process has been presented for the purposes of illustration and description. It is not intended to be exhaustive or to limit the invention to the precise form described, and many modifications and variations are possible. The implementations were chosen and described in order to best explain the principles of the invention and its practical applications.

Figure 8:
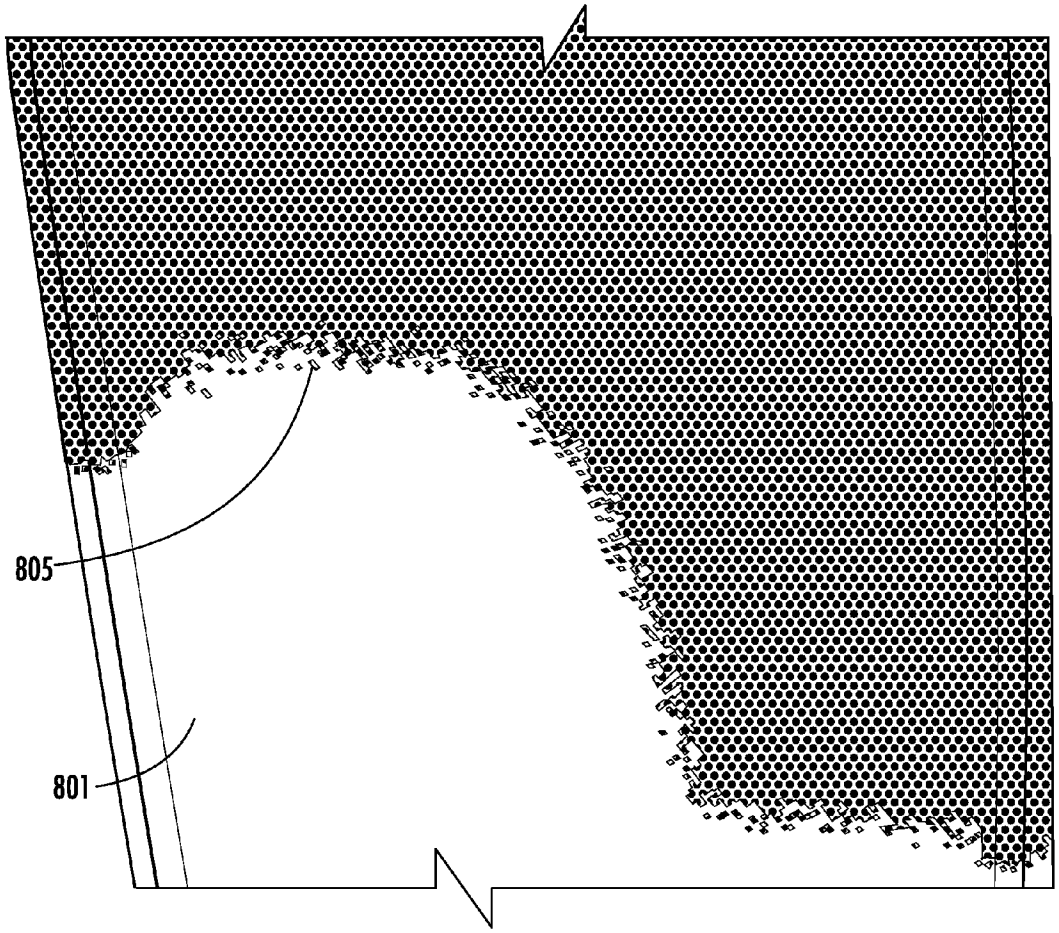
FIG. 8 shows a specific implementation of the panel with a graduated edge printed onto the inside surface of a pair of jeans.

In a specific implementation, the printed panel has a graduated edge. FIG. 8 shows a panel with graduated edge 805 printed onto the inside surface 801 of a pair of jeans. The graduated edge provides a smooth, seamless transition between the printed panel and the underlying fabric. As a result, no visible seams (or lines, hems, or edges) show through the outer fabric when the pants are worn by the wearer. U.S. patent application Ser. Nos. 29/431,723 and 29/431,724 are incorporated by reference.

Figure 9B:
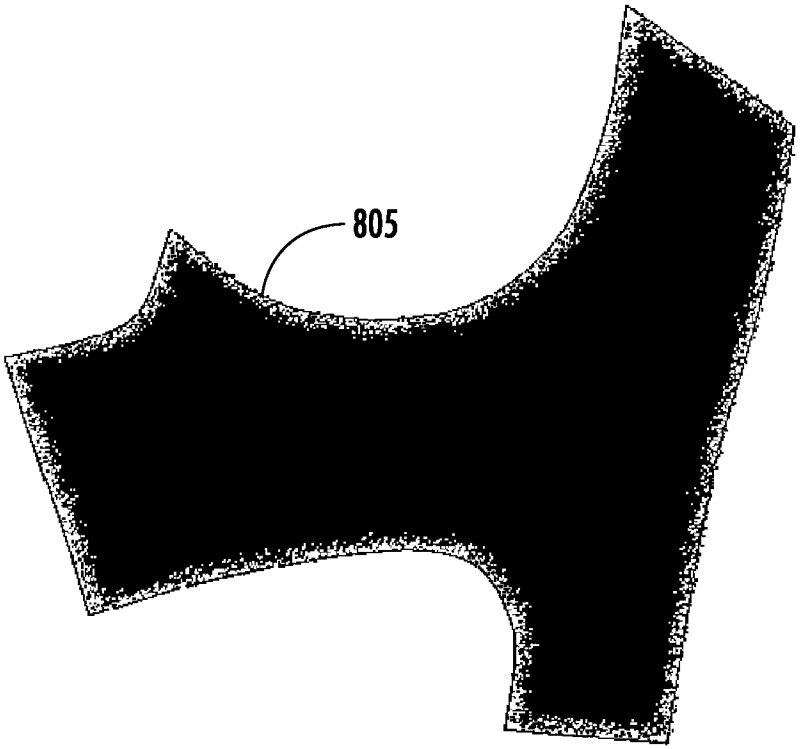
FIG. 9B shows a specific implementation of a printed back panel for pants, the back panel having a graduated edge.
Figure 9A:
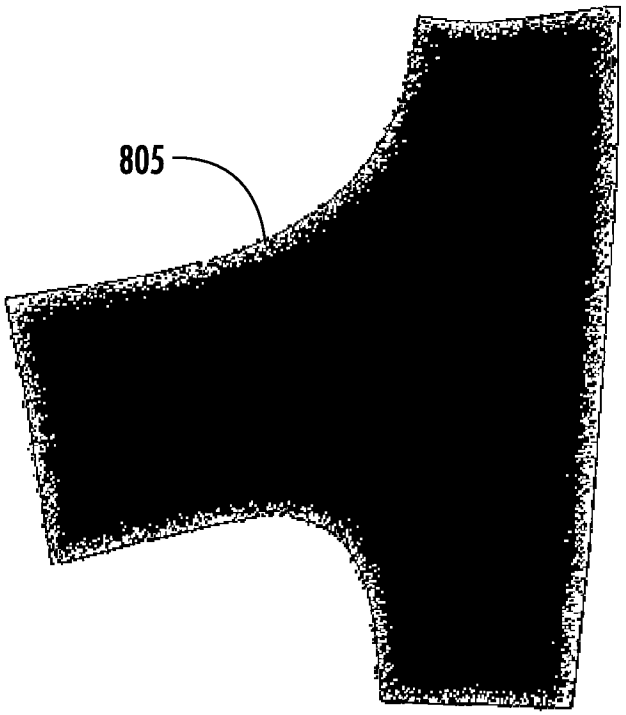
FIG. 9A shows a specific implementation of a printed front panel for pants, the front panel having a graduated edge.

FIGS. 9A-9B show an implementation of printed panels for pants having a graduated edge 805. FIG. 9A shows a front panel and FIG. 9B shows a back panel.

Figure 10:
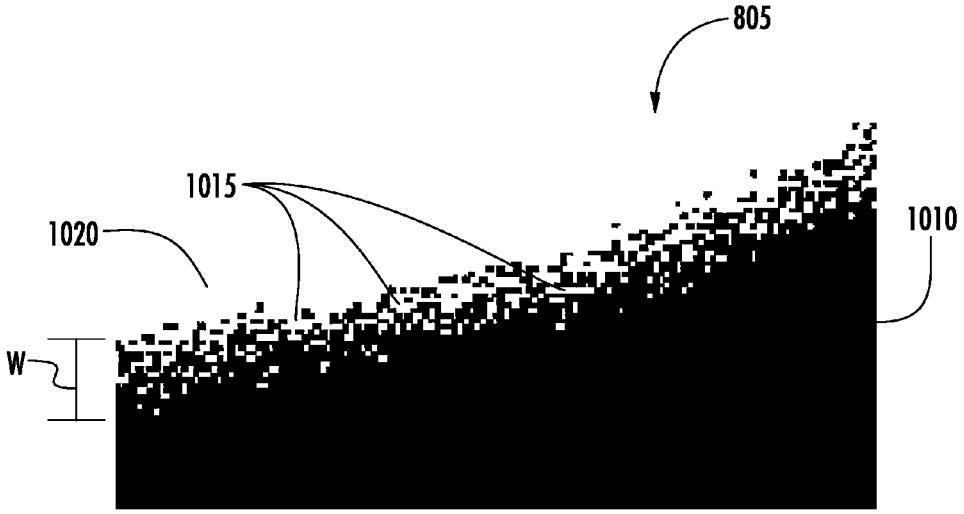
FIG. 10 shows a magnified view of a portion of the graduated edge.

FIG. 10 shows a magnified view of a portion of the graduated edge 805. In an implementation the panel is a solid fill 1010 of the coating mixture, while the edges include open spaces 1015 of underlying fabric 1020 (shown as white space in FIG. 10) where the coating mixture did not adhere. In a specific implementation, a width (w) of the gradation edge is about ½ inch to about 1 inch. In other implementations, the dimension of the gradation edge can be less or more, and the solid fill area can also be graduated in varying intensities.

As described above, it is not necessary that the panel is made according to a pattern. The shape of the panel can be indefinite and arbitrary (e.g., straight, curved, graduated, stipulated, or patterned). Furthermore, in some implementations, the edge may not be visible on the inside surface of the fabric because it is hidden by a seam, other material or fabric, a pocket, a zipper, a button, or the like.

In a specific implementation, the fabric is denim. Denim includes cotton and spandex (or Lycra®). Spandex is a synthetic fiber that gives greater elasticity to the cotton material, especially compared to 100 percent cotton denim. A specific brand of spandex is Lycra®. Lycra fiber is a trademark of Invista.

Referring back to FIG. 2, the fabric with the printed panel is cut or otherwise shaped according to a pattern for the manufacture of a garment.

In a specific implementation, where the Levi's Revel system is used as an extension to the Curve ID system, to facilitate the manufacture of pants with shaped fit sizing, fabric patterns are created based on the determined shaped fit categories (e.g., slight curve, demi curve, bold curve, and supreme curve). The fabric patterns are patterns used for cutting of the material for the pants. After the pieces are cut based on the pattern, the pieces are sewn together. Additionally, rivets may be used to hold some pieces (e.g., pocket openings) together, which increases durability and strength. See U.S. Pat. No. 139,121, issued on May 20, 1873 to Levi Strauss & Co.

In a specific implementation, fabric patterns are generated by an engineer (who may be referred to as a "pattern engineer") with a computer aided design (CAD) tool. The engineer uses the tool to create individual pattern components. These pattern components are two-dimensional patterns. For example, Assyst GmbH, Autometrix, OptiTex, Bluewater Software, Gerber Scientific, Inc., and Quest CAD/CAM are manufacturers of apparel CAD software tools. With an apparel CAD tool, 2D fabric patterns are developed. The tool may also include a 3D visualization component the may used to show the design from a three-dimensional perspective.

To ensure the fit is good, pants can be manufactured according to the computer generated patterns. Then an actual person can try pants. Based on the results, the engineer can make further modifications to the computer patterns. This process can be repeated as needed to ensure good fit and a proper look.

Separate patterns are created for each pair of jeans of a particular size and shape category. For example, there is a first pattern for a size 27 jean in the slight curve category. There is a second pattern for a size 27 jean in the demi curve category. There is a third pattern for a size 27 jean in the bold curve category. Sizings may be from waist size 23 to 34, with different inseam sizes.

Jeans with the same waist size are made with different inseam measurements to accommodate people with longer or shorter legs. Jeans also are made with different boot cuts or leg cuts such as skinny, straight, skinny boot, boot cut, flare, wide, trouser, boyfriend, and others. These may use different patterns. Since the inseam sizes and boot cuts do not necessarily affect the fit in the seat area (which is sometimes called the top block), some of the pattern pieces or portions or pattern pieces may be similar or the same as jeans with different inseam or boot cuts. The top block is a cut of the jean from the waistband through the hips and butt. Therefore, the top block can remain the same or about the same for some jeans, while the inseam and leg cuts will differ.

The patterns for the pieces are designed to facilitate shaped fit sizing. So for a single size (e.g., size 27) of jeans in the three different shaped fits, the patterns will differ to achieve the desired shaped fit. One pattern piece for jeans is the waistband. In a specific implementation, a difference between waistbands for one shaped fit (e.g. slight) and a curvier shaped fit (e.g., bold) is that the two-dimensional (2D) waistband pattern is more arced or curved.

Referring back to FIG. 2, cosmetic finishing techniques are applied to the outside of the jeans to further flatter the figure of the wearer. Seaming and construction techniques can also be applied to create the look of a shapely silhouette.

Cosmetic finishing techniques can include strategic placement of whiskers (e.g., straight or angled) on the front of the jeans, and the addition of highlights to the center front leg and low lights toward the inner and outer thigh to visually slim and elongate the hips and thighs. Further, a knee positioning is raised to lengthen the leg, the addition of downward pointing chevrons on the inner and outer thigh to create a slimming visual, and the addition of highlights under the seat and feathering up to create a lifted seat look. Other cosmetic finishing techniques can also be included.

The cosmetic finishing techniques can be applied differently for various body shapes. Where there are several shaped categories of fit, a woman with a less curvy shape may want to emphasize her natural curves while a woman with a more curvy shape may want to hide or de-emphasize those same curves on her body.

In a specific implementation where the Revel system is used as an extension to the Curve ID system, cosmetic finishing techniques include addition of whiskers, placement of abrasion patters, and addition of low lights.

Figure 11C:
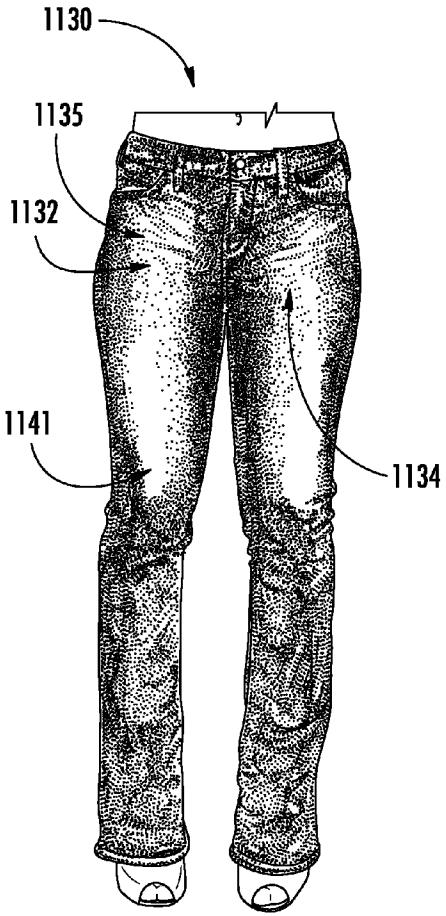
FIGS. 11A-11C show specific implementations of various cosmetic finishing techniques that can be applied to a front side of shaped fit jeans to create a shaped silhouette.
Figure 11B:
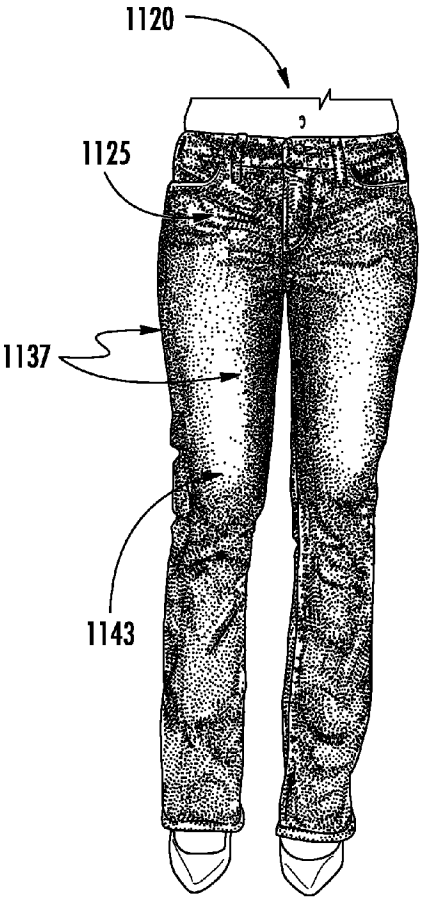
Figure 11A:
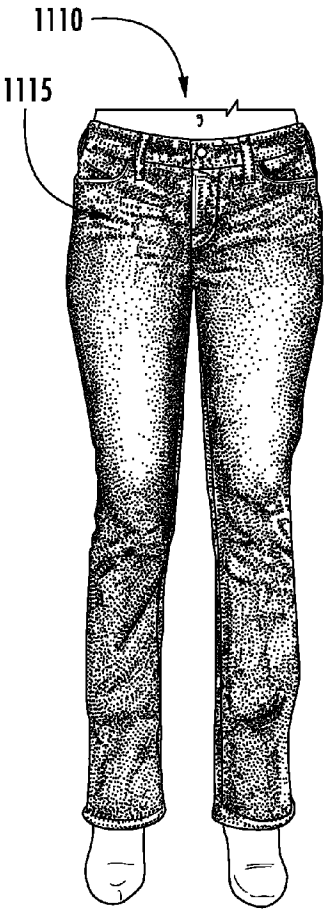

FIGS. 11A-11C show specific implementations of various cosmetic finishing techniques that can be applied to the front side of shaped fit jeans to create a shaped silhouette. FIG. 11A shows an example of jeans having a slight curve. FIG. 11B shows an example of jeans having a demi curve. FIG. 11C shows an example of jeans having a bold curve.

For the slight curve category, angled whiskers 1115 are added at such an intensity to accentuate the curve of the hip. For the demi curve category, the angle and intensity of whiskers 1125 compliments the curve of the hip, while for the bold curve category, the angle and intensity of whiskers 1135 deemphasize the widest part of the hips. Horizontal whiskers can be eliminated 1132 from the bold curve category, since horizontal lines can draw attention to the widest part of the hips. Subtle wear characteristics 1134 on the front side of the jean can deemphasize the front hip area. Darker shading 1137 (e.g., low lights) can be added to the inner and outer thighs of jeans in all fit categories to visually slim and lengthen the thighs. Abrasion patterns 1141 (e.g., highlights) can be added to the front narrow portion of the thigh to create a slim and elongated looking thigh. The abrasion pattern can be shortened for each shape category, all shape categories, or any combination of shape categories. The shortened abrasion pattern 1143 can be added to visually lengthen the leg.

Figure 12C:
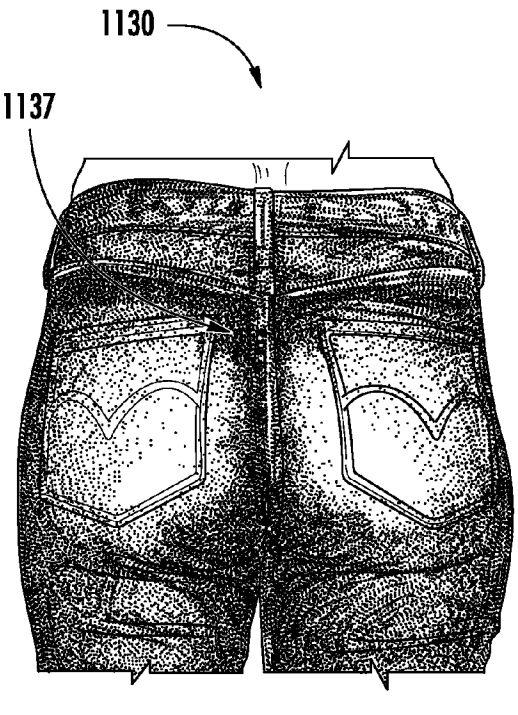
FIGS. 12A-12C show specific implementations of various cosmetic finishing techniques that can be applied to a back side of shaped fit jeans to create a shaped silhouette.
Figure 12B:
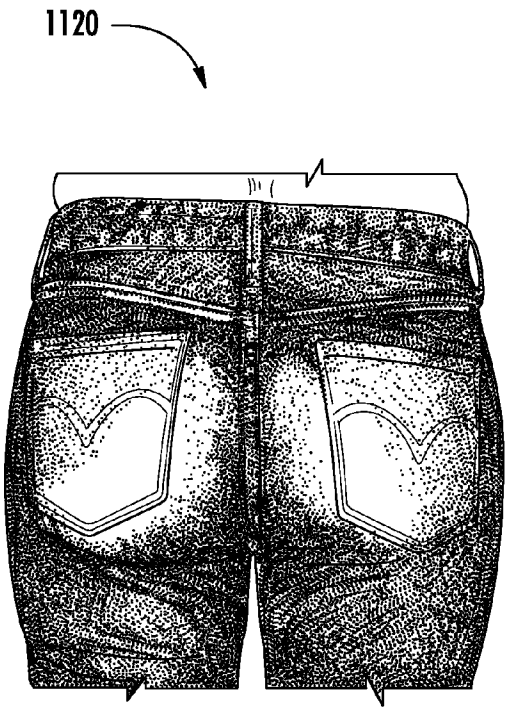
Figure 12A:
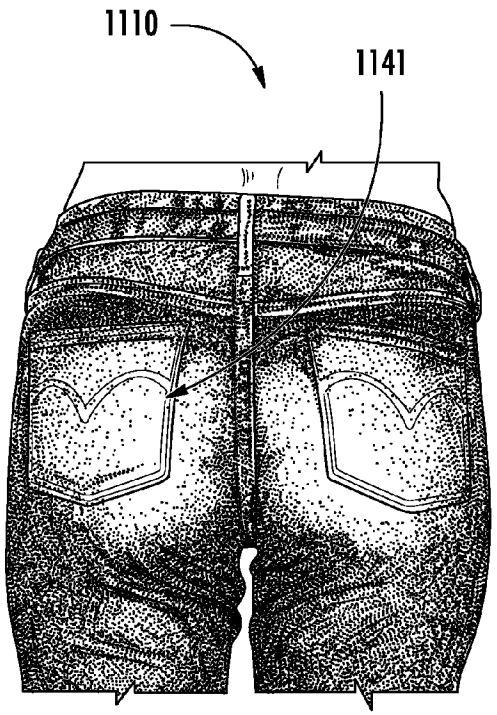

Cosmetic finishing techniques are further applied to the back of the jeans. FIGS. 12A-12C show specific implementations of various cosmetic finishing techniques that can be applied to the back side of shaped fit jeans to create a shaped silhouette. FIG. 12A shows an example of jeans having a slight curve. FIG. 12B shows an example of jeans having a demi curve. FIG. 12C shows an example of jeans having a bold curve.

Abrasion patterns 1141 can be added to jeans of all fit categories along the rounded portions of the seat to enhance the curves of the seat. The size and positioning of the abrasion pattern can vary with each shape category to accommodate different body shapes. Low lights can be added to de-emphasize larger curves. The low lights 1137 (or darker shading) can be added to the periphery of the abrasion pattern to create a gradual, receding effect to deemphasize strong curves. For example, more low lights can be added in the more curvy shape categories (e.g., bold curve and supreme curve) to more greatly de-emphasize the widest portions of the seat.

Seaming and construction techniques are shown in FIGS. 1A and 1B. These techniques can include: front seaming 110 inside pocket scoops 112 (e.g., front curved pocket scoops) to draw the eye up to the waist and away from the widest part of the hips, omission of a coin pocket to provide less bulk and a smoother silhouette; a curved riser seam 114 that physically lifts the seat and visually creates either a shapely or de-emphasized seat; placement and size of back pockets 116 to either provide shape or to minimize appearance; an inset riser panel 118 that physically smoothes the sides of the body; darting at the back of the jeans to eliminate drag lines and visually lift the seat; construction of inner pocket to control and smooth the stomach; and slightly forward-placed side seams (see reference number 360 in FIG. 3A) to draw the eye inward to create a narrower silhouette. Other seaming and construction techniques can also be included.

The seaming and construction techniques can be applied differently for various body shapes. Where there are several shaped categories of fit, a woman with a less curvy shape may want to emphasize her natural curves while a woman with a more curvy shape may want to hide or de-emphasize those same curves on her body.

In a specific implementation where the Revel system is used as an extension to the Curve ID system, any combination of the techniques described above can be used to create a shaped look. The combination of techniques can be applied to a single shape category, all shape categories, or any combination of categories. For example, a pair of size 30 jeans with a less curvy shape (e.g., slight curve category) can have a different back pocket size and placement than for a size 30 jean with a more curvy shape (e.g., bold curve or supreme curve categories).

Consumers can use the Curve ID system to find the perfect fit based on body type. To use the Curve ID system, a consumer finds their shape using a shape measuring tool. The shape measuring tool calculates a shape category based on a differential of two body measurements. With this shape category information, the woman can easily locate a pair of form-fitting jeans.

As discussed above, in the Revel system, form-fitting jeans are specifically engineered and designed for the consumer's body shape. The jeans provide support for the consumer's seat, hip and thigh areas by incorporating shape contouring panels that are made by a printing process on the inside surface of the jeans. The panels are uniquely positioned on the inside of the jeans to smooth and hold in the stomach, hips, and inner and outer thighs, while lifting the seat. In addition, the finish of the jeans can be specifically designed for the consumer's body shape. Various garment construction and cosmetic finishing techniques can also be used to create an illusion of longer, leaner thighs, a lifted seat, and flattering curves at the hip and seat.

Figure 13:
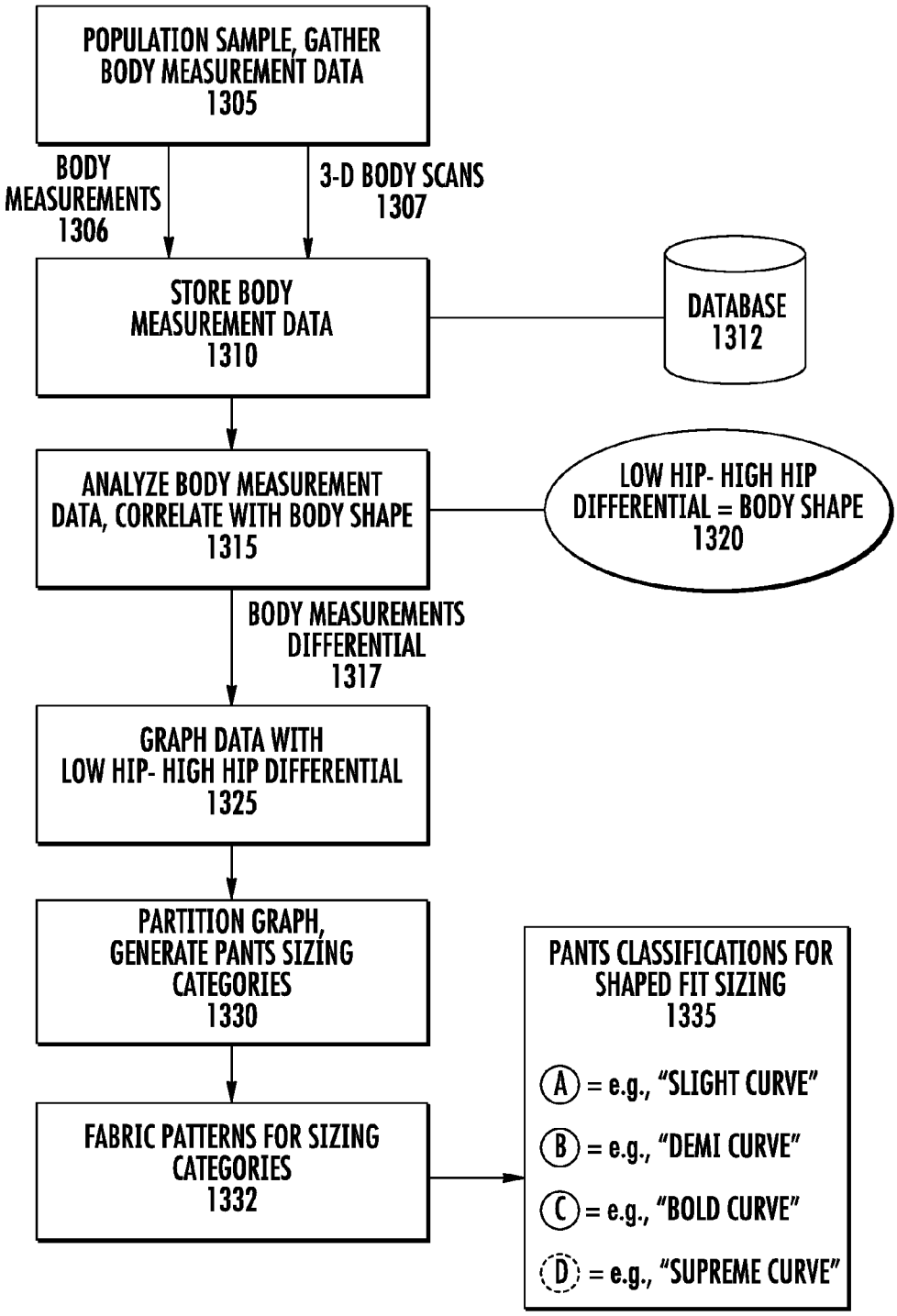
FIG. 13 shows a system of shaped fit sizing for pants. These pants include fashion jeans and shorts.

FIG. 13 shows a system of shaped fit sizing for pants. A shaped fit sizing system is targeted to specific consumers. For example, a specific target market for shaped fit is the U.S. women's market. Other markets may be in other geographic areas, such as Asia and Russia. The shaped fit sizing system can be tailored to specific markets and populations. This will ensure the shaped fit sizing system will have sizings to accommodate the great majority of the consumers and body types in those markets.

The system in FIG. 13 can achieve shaped fit sizing for pants for a targeted population. The system has components to generate metrics upon which to classify pants having shaped fit sizes. Components include: selecting a population sample and collecting body measurement data for this sample 1305. The collected body measurement data can include body measurements 1306 and digital body scans 1307. This measurement data 1310 can be stored in, for example, a database 1312, for subsequent analysis and correlation 1315. This analysis determines a body measurement differential 1317 upon which body shape can be based. In a specific implementation, the selected differential is a low hip to high hip differential 1320. The differential data is graphed 1325 and partitioned 1330, which forms the pants sizing categories or classifications 1330. Based on the determined sizing categories, fabric patterns 1332 are created. The fabric patterns are used to manufacture pants with the shaped fit sizing 1335.

In a specific implementation, there are three sizing categories 1335, which are identified as shaped fit sizings A, B, and C. The sizings can be referred to by other names. For example, for Curve ID, the names are slight, demi, and bold. Or the shaped fit sizings may be referred to using different colors.

In another specific implementation, there is an additional shaped fit sizing D. For Curve D, this sizing name is supreme. Shaped fit sizing D is optional and may not be available in every target market. Depending on the demographics of a target population, this additional shaped sizing can ensure that greater numbers (e.g., a greater percentage) of consumers will fit into the available shaped sizings. For example, in one marketplace, there may be people who do not fit size C, so they will need to buy size D clothes. However, in a different marketplace, there may not be any (or many) people who will fit size D, so size D clothes are not needed or sold there.

Target populations are typically divided geographically because clothing is usually sold on a geographical basis. So, there is a population of people where it is desirable to obtain shaped fit sizing for pants. Additionally, as desired to target the market and consumer better for better fit, this population may be divided by age, sex, ethnicity, or other parameters, or combinations of these. More details on collection and analysis of body measurement data are discussed in U.S. Pat. No. 8,307,560, which is incorporated by reference.

Figure 14:
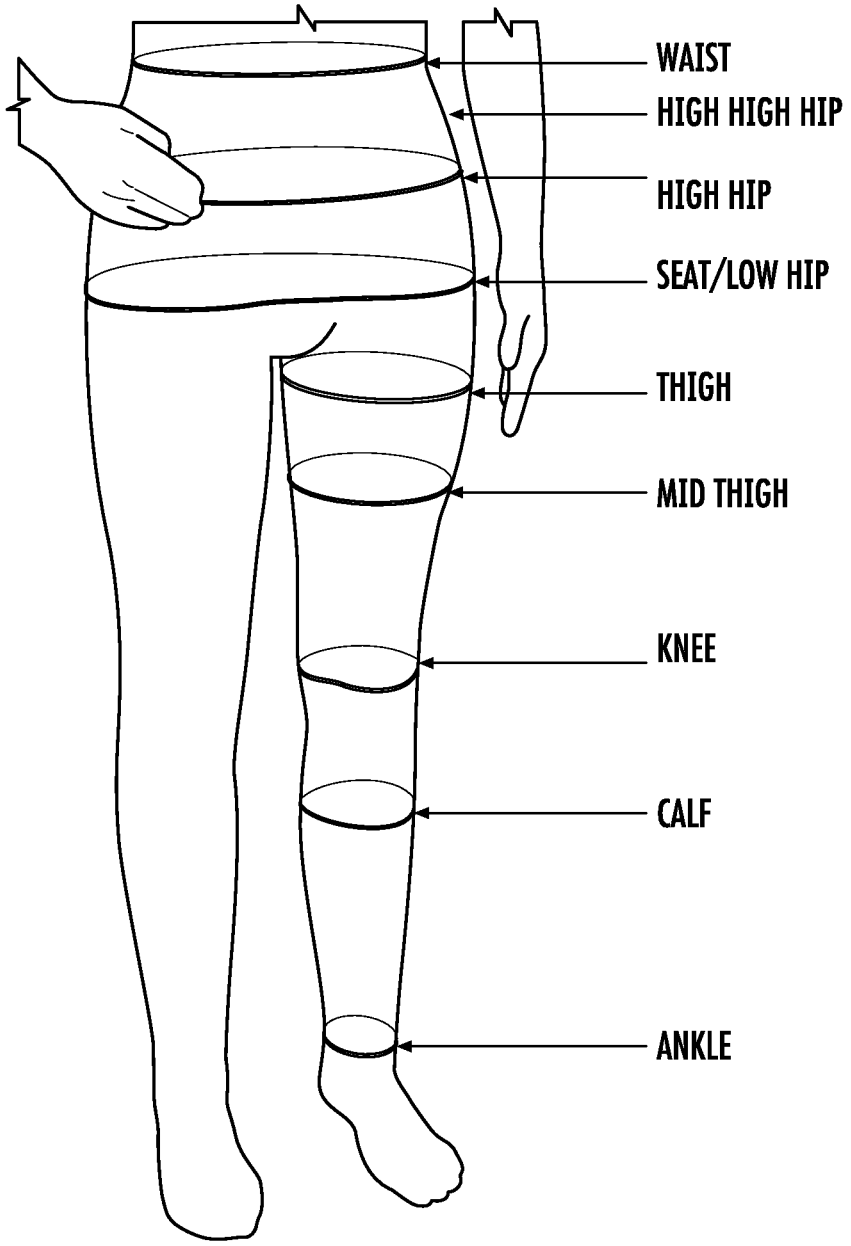
FIG. 14 shows various points on a person, below a waist point, at which girth can be measured.

FIG. 14 shows various points on a person, below a waist point, at which girth can be measured. The points include a natural waist, hi-high hip, high hip, seat (or low hip), thigh, mid thigh, knee, calf, and ankle. Any or all these measurements may be included in the body scan data.

Natural waist refers to the location at which the body, and specifically the torso, bends. So, when a person bends sideways, the point of the bend on the torso is the natural waist. This is a reference point from which measurements are made. By using the same reference point on different people, this allows a consistent measurements from person to person, regardless of what each person considers their waist (which can vary from person to person).

Figure 15:
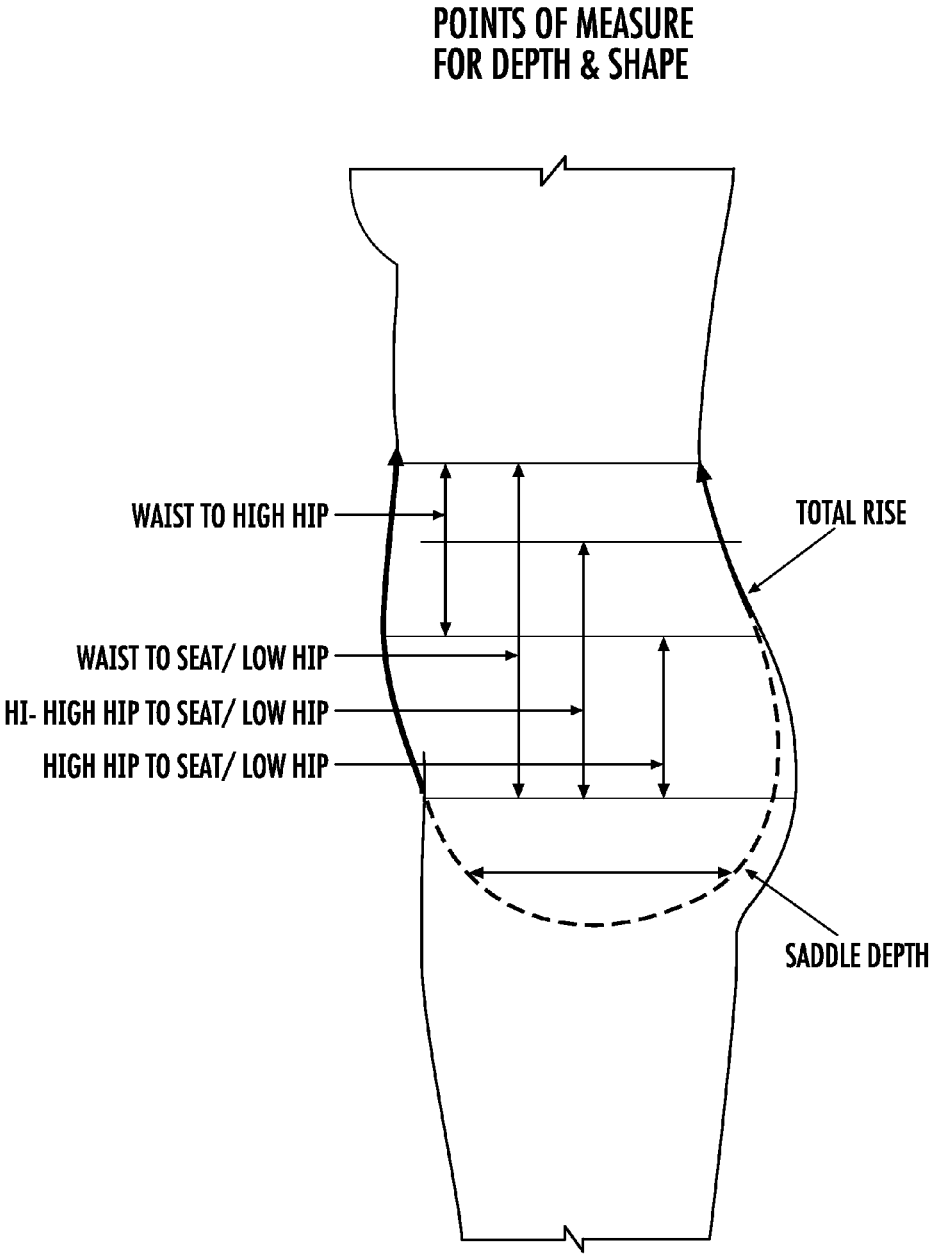
FIG. 15 shows some points at which differential girth body measurements can be measured on a person. These differential girth body measurements can be used as an indication of depth and shape of a person.

FIG. 15 shows some points at which differential girth body measurements can be measured on a person. These differential girth body measurements can be used as an indication of width, depth, and shape of a person. These differentials include the natural waist to high hip, natural waist to seat (or low hip), hi-high hip to seat, and high hip to seat. A differential is a difference between two lower body parameters. Other measurements include total rise and saddle depth. Any or all these differential measurements may be included in the body scan data, or calculated from the body scan data.

The differentials in FIG. 15 are in reference to the natural waist described above. The high hip is located about 4 inches (or about 10.2 centimeters) below the natural waist. The seat or low hip is typically located about 4 inches below the high hip or about 8 inches (or about 20.3 centimeters) below the natural waist.

Returning to FIG. 13, the collected body measurement data is analyzed 1315 to determine which of the numerous measurements taken and available correspond to body shape, and can be used as a basis for shaped fit sizing pants. FIG. 14 shows nine girth measurement points, and FIG. 15 shows four differential body measurements. There are many combinations of measurements to consider. These and other measurement points (not indicated) were considered.

The analysis, including statistical and mathematical calculations, found the low hip (or seat) to high hip differential correlates highly with body shape. The other differentials listed in FIG. 15 also correlate to body shape, but the low hip-high hip differential was selected. In alternative implementations, the shaped fit sizing system can use any of the other differentials—natural waist to high hip, natural waist to low hip, or hi-high hip to low hip.

To analyze the data and generate the charts, the components or subcomponents of the analysis and correlation component can include and be performed by a computer system. The computer system can include, for example, a computer screen to electronically display the graphs and charts. The computer system can include software programs stored in computer memory for performing (via a computer processor) the statistical analyses.

In a specific implementation, the result or output of analysis 1315 is the identification of low hip-high hip differential 1320 as indicative of body shape or body geometry. The low hip-high hip differential is used in Curve ID, where low hip is measured 8 inches from the natural waist and high hip is measured 4 inches from the natural waist. The differential may also be referred to as a shape index. Other names can be used.

For Curve ID, a difference between the high hip and low hip measurement is about 4 inches (i.e., 8 inches minus 4 inches). For shaped fit sizing system, the difference between the two body measurement points can vary. However, better accuracy and fit can be obtained when the body point differences is greater than about 3 inches. The body point differences can even be greater than the 4 inches used for Curve ID. Generally, smaller differences such as 0.5 inches or 1 inches of difference in the body points may not give as accurate a measure of body shape.

The selected body measurement differential 1317 for the target population is analyzed 1325. The analysis can include graphing the differential amounts for the target population to see a distribution of body shape. Further analysis can include raw body measurement charts, graded body measurement charts, measurement distribution graphs, comparative distribution graphs (e.g., comparing different age groups, different countries, different regions, different lifestyle groups, or combinations of these). The analysis can include statistical analyses and calculations of the data.

A distribution curve may be calculated using any demographic or combination of demographics of the human population. For example, depending upon the target market, a distribution curve may be calculated based on demographics such as gender (e.g., male and female), age bracket (e.g., 15-24 year olds and 25-34 year olds), geographic region (e.g., U.S., China, Japan, France, Germany, or Russia), or combinations of these.

Graph data 1325 is analyzed and partitioned 1330 to generate a shaped fit sizing system for pants 1335. Fabric patterns are created that correspond to the shaped fit categories 1332. The pants are manufactured according to these fabric patterns.

An implementation has three shaped fit categories, each spanning 1.5 inches of differential. A first differential range (shaped fit size A or slight) is from about 2 inches to about 3.5 inches (about 5.1 centimeters to about 8.9 centimeters). A second differential range (shaped fit size B or demi) is from about 3.5 inches to about 5 inches (about 8.9 centimeters to about 12.7 centimeters). A third differential range (shaped fit size C or bold) is from about 5 inches to about 6.5 inches (about 12.7 centimeters to about 16.5 centimeters).

Based on graph 1325, this system of shaped fit categories with 1.5-inch ranges covers about 80 percent of the target population. However, it may be desirable to increase coverage. Therefore, an alternate implementation includes a fourth shape fit category. This fourth differential range (shaped fit size D or supreme) is from about 6.5 inches to about 8 inches (about 16.5 centimeters to about 20.3 centimeters). With this additional shaped fit, the coverage of the system is over 80 percent of the target population.

The curve may be partitioned or segmented into any number of differential ranges (e.g., more or fewer than three, two, five, six, or seven). Generally, the greater the number of partitions or ranges the more likely it is that a person will be able to find a pair of pants that fits the person's shape more closely.

For example, the three shaped fit sizes described spans from 2 inches to about 6.5 inches, which is 4.5 inches of differential total. This range can be split into five shaped fit categories, each covering a 0.9 inches range (for symmetrically or identically sized ranges). However, this leads to having two additional shaped sizing categories, which compared to three sizing categories, complicates manufacturing and generally increases costs. Each additional sizing category can increase the cost to make the pants because for each garment waist size there is an additional shape fit size.

Thus, it will be desirable to identify and select groups of ranges that are most common and represent the desired coverage of the target market. In a specific implementation, there are at most three sizing classifications or three sets of differential ranges to achieve the desired coverage. In another specific implementation, there are at most four sizing classifications to achieve the desired coverage.

Although symmetrically or identically sized differential ranges have been described, a shaped fit sizing system of the invention can include asymmetrically or differently sized differential ranges. For example, the second differential range described above can be split into two ranges, such as one from 3.5 to 4.25 inches and another from 4.25 to 5 inches, while the first and third differential ranges remain the same size.

The 1.5-inch differential ranges can be for denim which is used in jeans. The size of each differential range also depends on the stretch of the fabric or material used for the pants. Generally, the greater stretch the material has, the larger the range can be since the material can stretch to accommodate larger shaped fit sizes. Material with less stretch may need smaller differential ranges, and therefore a greater number of categories.

In a specific implementation, denim includes cotton and spandex (or Lycra®). Spandex is a synthetic fiber that gives greater elasticity to the cotton material, especially compared to 100 percent cotton denim. A specific brand of spandex is Lycra®. Lycra fiber is a trademark of Invista.

A stretch denim typically has cotton and 2 percent spandex. Generally, the amount of spandex in denim varies from about 1 to 5 percent. However, depending on the amount of stretch desired, the amount of spandex in denim can be up to about 10 to about 15 percent. In certain circumstances (e.g., specialized wear), the denim can have even greater than 15 percent spandex.

Also, the particular weave used to weave the cotton and spandex together to make the denim will affect the stretch. With the weave and spandex, the denim material can have different stretch levels. In a specific implementation, the denim material is designed to stretch from about 15 to 35 percent. In this specific implementation, the determined differential ranges (e.g., 1.5-inch differential) and shaped fit sizing categories handle denim with a stretch from about 15 to 35 percent. However, depending on the weave and amount of spandex, the stretch can range extend from about 12 to 45 percent.

To facilitate the manufacture of pants with shaped fit sizing 1335, fabric patterns 1332 are created based on the determined shaped fit categories 1330. The fabric patterns are patterns used for cutting of the material for the pants. Typically, there are about 10 to 15 patterns (which means there are 10 to 15 pieces of material) used for each shaped fit jean. After the pieces of material are cut based on the pattern, the pieces are sewn together. Additionally, rivets may be used to hold some pieces (e.g., pocket openings) together, which increases durability and strength. See U.S. Pat. No. 139,121, issued on May 20, 1873 to Levi Strauss & Co. More details on the manufacture of pants with shaped fit sizing are discussed in U.S. Pat. No. 8,307,560, which is incorporated by reference.

The patterns for the pieces are designed to facilitate shaped fit sizing. So for a single size (e.g., size 27) of jeans in the three different shaped fits, the patterns will differ to achieve the desired shaped fit. One pattern piece for jeans is the waistband. In a specific implementation, a difference between waistbands for one shaped fit (e.g. slight) and a curvier shaped fit (e.g., bold) is that the two-dimensional (2D) waistband pattern is more arced or curved.

For example, for the slight curve (e.g., size 27), a waistband top is about 31 inches while a waistband bottom is about 31.25 inches, which is about a 0.75-inch difference. In comparison, for the bold curve (e.g., size 27), a waistband top is about 28 inches while a waistband bottom is about 29.5 inches, which is about a 1.5 inch difference. The greater this difference, the greater arc or curve in waistband pattern. This is a reason why the bold curve waistband pattern piece is more curved than slight curve waistband pattern piece.

Figure 16:
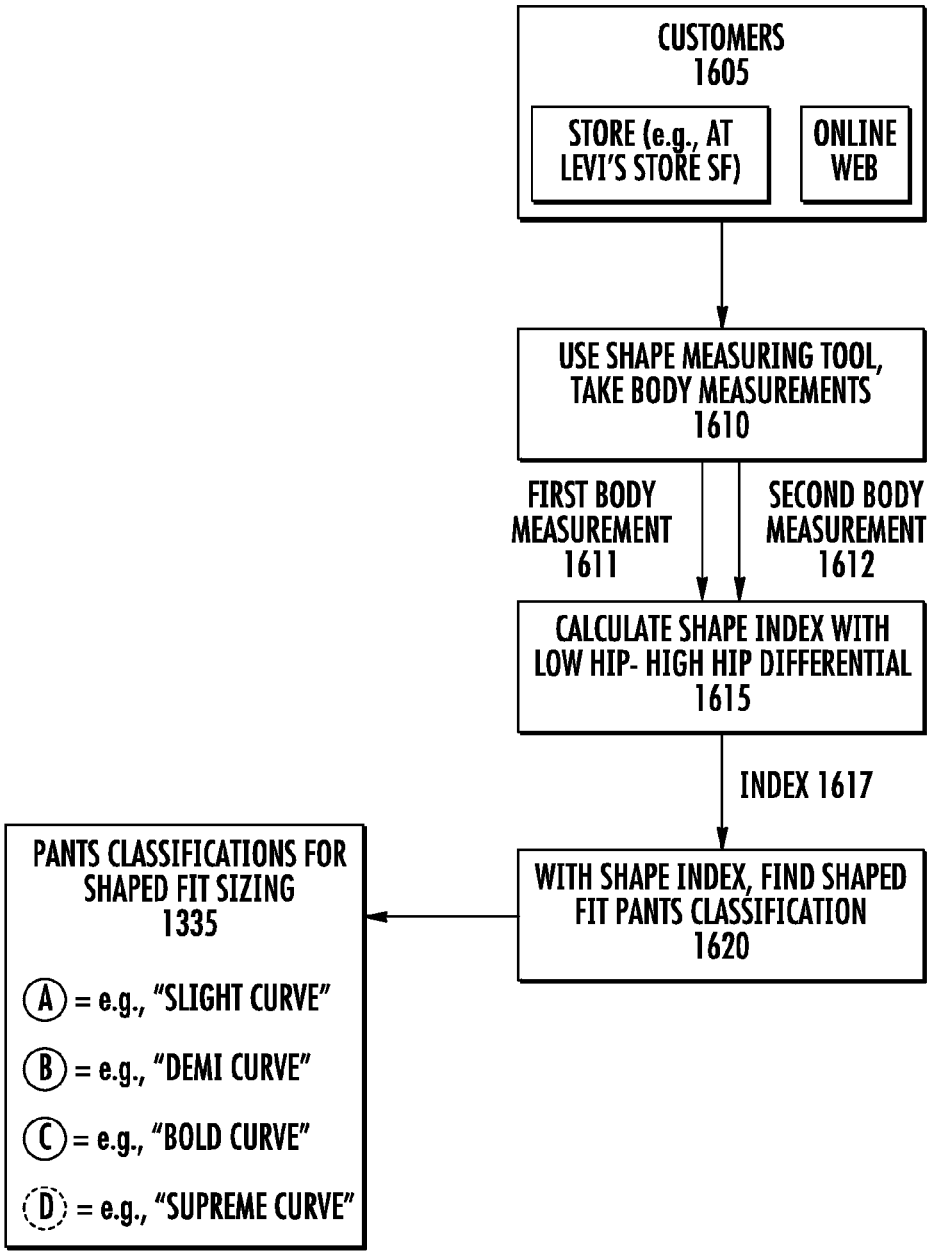
FIG. 16 shows a system for fitting a person to pants having shaped fit sizing.

FIG. 16 shows a system for fitting a person to pants having shaped fit sizing. Jeans with shaped fit sizing are available to consumers or customers 1605 through various channels. A channel for selling and making jeans available are stores. For example, Levi's Curve ID products are available at Levi retail stores (e.g., San Francisco store) or other retailers such as Macy's, J.C. Penny, and Kohl's (which may be referred to as wholesalers). A channel for selling and making jeans available on-line are Internet and Web sites.

A shape measuring tool 1610 is used to fit the consumer. In a store, a salesperson can use the shape measurement tool to measure the consumer, and find which of the shaped fit sizing categories (e.g., A, B, or C) the consumer falls within. Two girth measurements 1611 and 1612 are made. A calculation 1615 is made that indicates a shape index 1617. With the shape index, the consumer will be able to determine their shaped fit pants classification or category 1620. The consumer can choose the jeans 1335 with the appropriate shaped fit sizing.

Table A below provides a specific example of a flow for making different measurements 1610 and determining a shape index 1615. A specific implementation of the fit system of the invention is the Levi's Curve ID® system. It should be understood that the invention is not limited to the specific flows and steps presented. A flow of the invention may have additional steps (not necessarily described in this application), different steps which replace some of the steps presented, fewer steps or a subset of the steps presented, or steps in a different order than presented, or any combination of these. Further, the steps in other implementations of the invention may not be exactly the same as the steps presented and may be modified or altered as appropriate for a particular application or based on the data or situation.

TABLE A

| | |
|---|---|
| Step 1 | Make a first girth measurement 1611 at a first position (e.g., high hip) of a person's body. |
| Step 2 | Make a second girth measurement 1612 at a second position (e.g., seat or low hip) of person's body. |
| Step 3 | Subtract the first measurement from the second measurement to determine a shape index 1617. |

For steps 1 and 2, the shape measuring tool used can include a measuring tape or tape measure. This measuring tape can a relatively narrow strip of flexible material with ruled markings in units such as inches (U.S. customary units) or centimeters (metric or SI). The measuring tape is flexible to conform to the person being measured and can be wrapped around a person's girth or circumference.

As discussed above, a reference point used for the measurements is the natural waist is the point at which the person can bend his or her body. The high hip position is located about 4 inches (about 10.2 centimeters) down from the person's natural waist. The low hip or seat is located about 4 inches down from the high hip, or about 8 inches down from the person's natural waist.

The measurements relative to the natural waist can be determined also by using a measuring tape (e.g., another measuring tape, separate from the girth measuring tape), which can lay along the person's body shape vertically (which is generally perpendicular or transverse to the girth measurements and girth measuring tape). First and second girth measurements are made at the high hip and the low hip positions.

For step 3, shape index 1617 is a differential which is a result of subtracting first girth measurement 1611 from second girth measurements 1612. The value of the shape index (or differential) identifies the shaped fit category (A, B, or C) of pants for the user. The subtraction in step 3 can be done by the salesperson. Or the subtraction may be performed using a computer processor, such as in an electronic calculator or a computer (e.g., Web site performs calculation for on-line consumer). The shape index is relatively easy and straightforward to calculate.

For example, if the determined shape index is in a range from about 2 inches to about 3.5 inches (about 5.1 centimeters to about 8.9 centimeters), the shaped fit sizing will be the first fit category A (e.g., slight curve). If the determined shape index is in a range from about 3.5 inches to about 5 inches (about 8.9 centimeters to about 12.7 centimeters), the shaped fit sizing will be the second fit category B (e.g., demi curve). If the determined shape index is in a range from about 5 inches to about 6.5 inches (about 12.7 centimeters to about 16.5 centimeters), the shaped fit sizing will be the third fit category C (e.g., bold curve).

As an example, a person measures to have a high hip girth of 28 inches and a low hip girth of 34 inches. A difference between the high hip and low hip is 34 inches minus 28 inches, which is 6 inches. This corresponds to fit category C (e.g., bold curve).

These fit categories are for off-the-rack pants or jeans, which have been previously manufactured according to specifications for the shaped fit sizing categories. This is not custom tailoring because the person's measurements are made after the pants have already been made. The measurements are to perform a fitting of the person to the predetermined shaped fit categories or classifications.

As previously described, optionally, there can be a shaped fit category D (e.g., supreme curve), which is fit for a shape index or differential of about 6.5 inches and about 8 inches (about 16.5 centimeters to about 20.3 centimeters). Also, note that the range for shaped fit category A starts at 2. However, if the consumer were to measure under 2 inches (i.e., 0 to 3.5 inches), the consumer can be fitted to category A pants (e.g., slight curve).

In some cases, a person's shape index may be at the lower or upper limit of a range. For example, the person's shape index may be about 3.5 inches. In this specific implementation, the person may be provided with pants having shaped fit sizing A, pants having shaped fit sizing B, or both pairs of pants. As another example, the person's shape index may be about 5 inches. In this specific implementation, the person may be provided with pants having shaped fit sizing B, shaped fit sizing C, or both pairs of pants.

In alternate system implementations, the shape index may be the result of other mathematical computation, not merely a subtraction. For example, the calculation may include adding the two measurements. The calculation may include taking a ratio (division) of the two measurements. For example, a ratio of shape may be determined by dividing the second girth measurement by the first girth measurement.

The flow in table A can be described in a measurement guide (e.g., training guide or video) that is distributed to the salespeople at the retail stores. The measurement guide can be a written description of how to how to measure and fit a person to the appropriate shaped fit pants. For example, the measurement guide indicates that a first girth measurement is to be taken at a first position below a person's waist, and a second girth measurement is to be taken at a second position below the person's waist. The measurement guide can be part of the shape measuring tool kit. The measurement guide may be posted or otherwise displayed in the retail store for the salespeople or consumers to review. The measurement guide may be posted on a Web site for on-line consumers.

There can also be a shape index chart which lists the pants sizing for particular differentials, also distributed to the sales people at the retail stores. The shape index chart can be a written description listing the first, second, and third predetermined shaped sizing category for jeans (e.g., A, B, and C). The shape index chart also indicates the first and second girth measurements corresponding to the first predetermined shaped sizing category, second predetermined shaped sizing category, or third predetermined shaped sizing category. For example a difference between the first and second girth measurements of 2 to 3.5 will be shaped fit category A, 3.5 to 5 will be category B, and 5 to 6.5 will be category C. The shape index chart may be posted or otherwise displayed in the retail store for the salespeople or consumers to review. The shape index chart guide may be posted on a Web site for on-line consumers.

A sample shape index chart is in table B below. Once the shape index is know, the salesperson or consumer can look up the corresponding fit block or shaped fit sizing category.

TABLE B

| Shaped Fit Sizing (Fit Block) | Shape Index (Curve ID ®) |
|---|---|
| A (Slight Curve) | Up to 3½" |
| B (Demi Curve) | 3½" to 5" |
| C (Bold Curve) | 5" to 6½" |
| D (Supreme Curve) (optional) | 6½" to 8" |

This chart has a first section or row corresponding to the first predetermined shaped sizing category; a second section, adjacent to the first section, corresponding to the second predetermined shaped sizing category; and a third section, adjacent to the second section, corresponding to the third predetermined shaped sizing category. The second section is between the first and third section in the table; the corresponding shape index is numerically between the others. This index may be presented on multiple pages, and the second section is between the first and third section pages.

However, the chart presented in table B is relatively straightforward and easy to understand. Note that the ranges of the shape index overlap at specific measurements. For example, sizings A and B overlap at 3½ inches. However, as desired, the chart can also be written not to include such overlaps. For example, sizing A can be up to 3.49 inches, B from 3.5 to 4.99 inches, C from 5 to 6.49 inches, and so forth.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A pants comprising:

a denim material sewn into pants, wherein the denim material has a first stretch characteristic;

a polyurethane coating, applied to a portion of an inside of the denim material in an upper thigh region of the pants and avoiding a buttocks region, wherein the denim material with the polyurethane coating has a second stretch characteristic which is less elastic than the first stretch characteristic, and the polyurethane coating is not visible from an exterior of the pants; and a graduated edging to the polyurethane coating comprising a polyurethane coating graduated with a plurality of open spaces, wherein the graduated edging is positioned between a portion of the polyurethane coating comprising a solid polyurethane coating without open spaces as in the graduated edging and the buttocks region of the pants, where the polyurethane coating is omitted, and the polyurethane coating of the graduated edging comprises gradually increasing areas of open spaces in the polyurethane coating to transition from a solid fill region of the polyurethane coating to an unfilled region without the polyurethane coating, whereby the graduated edging avoids forming of a hard line.

2. The pants of claim 1 wherein the buttocks region of the pants has the first stretch characteristic that is more elastic than the upper thigh region of the pants where the polyurethane coating has been applied.

3. The pants of claim 1 wherein the denim material comprises cotton blended with a first fiber other than a cotton fiber.

4. The pants of claim 3 wherein the first fiber comprises spandex.

5. The pants of claim 1 wherein a width of the graduated edging is from about ½ inch (about 1.3 centimeters) to about 1 inch (about 2.5 centimeters).

6. The pants of claim 1 wherein the buttocks region of the pants extends from a waistband on an inside back of the pants to curved lines of the polyurethane coating extending on either side of a center seam, whereby the curved lines of the polyurethane coating are placed against naturally curvy portions of a person's seat.

7. The pants of claim 1 wherein from an outside view of the pants, the portion of the denim material with the polyurethane coating and a region of the denim material without the polyurethane coating as in the buttocks region, blend seamlessly together without any seam lines.

8. A pants comprising:

a denim material sewn into pants, wherein the denim material has a first stretch characteristic;

a polyurethane coating, applied to a portion of an inside of the denim material in an upper thigh region of the pants and avoiding a buttocks region, wherein the denim material with the polyurethane coating has a second stretch characteristic which is less elastic than the first stretch characteristic, and the polyurethane coating is not visible from an exterior of the pants; and a graduated edging to the polyurethane coating comprising a polyurethane coating graduated with a plurality of open spaces, wherein the graduated edging is positioned between a portion of the polyurethane coating comprising a solid polyurethane coating without open spaces as in the graduated edging and the buttocks region of the pants, where the polyurethane coating is omitted, and the graduated edging comprises a transition from a solid fill region of the polyurethane coating that gradually decreases in polyurethane coating fill density to an unfilled region without the polyurethane coating, whereby the use of the graduated edging avoids forming of an abrupt transition edge between the solid fill region of the polyurethane coating and the unfilled region.

9. A pants comprising:

a denim material sewn into pants, wherein the denim material has a first stretch characteristic;

a polyurethane coating, applied to a portion of an inside of the denim material in an upper thigh region of the pants and avoiding a buttocks region, wherein the denim material with the polyurethane coating has a second stretch characteristic which is less elastic than the first stretch characteristic, and the polyurethane coating is not visible from an exterior of the pants; and a graduated edging to the polyurethane coating comprising a polyurethane coating graduated with a plurality of open spaces, wherein the graduated edging is positioned between a portion of the polyurethane coating comprising a solid polyurethane coating without open spaces as in the graduated edging and the buttocks region of the pants, where the polyurethane coating is omitted, and the polyurethane coating of the graduated edging comprises a gradually increasing number of open spaces in the polyurethane coating to transition from a solid fill region of the polyurethane coating to an unfilled region without the polyurethane coating, whereby the graduated edging avoids forming of a hard line.

10. The pants of claim 1 wherein the graduated edging comprises a mesh of the polyurethane coating and open spaces within the polyurethane coating.

11. A pants comprising:

a denim material sewn into pants, wherein the denim material has a first stretch characteristic;

a polyurethane coating, applied to a portion of an inside of the denim material in an upper thigh region of the pants and avoiding a buttocks region, wherein the denim material with the polyurethane coating has a second stretch characteristic which is less elastic than the first stretch characteristic, and the polyurethane coating is not visible from an exterior of the pants; and a graduated edging to the polyurethane coating, wherein the polyurethane coating comprises a solid fill of polyurethane, and the graduated edging comprises a polyurethane coating gradually decreasing in fill density by including a plurality of open spaces without the polyurethane coating, and the graduated edging is positioned between a portion of the polyurethane coating comprising a solid polyurethane coating without open spaces as in the graduated edging and the buttocks region of the pants, where the polyurethane coating is omitted, and whereby the use of the graduated edging avoids an abrupt transition edge between the solid polyurethane coating without open spaces and the buttocks region of the pants where the polyurethane coating is omitted.

12. The pants of claim 11 wherein the buttocks region of the pants has the first stretch characteristic that is more elastic than the upper thigh region of the pants where the polyurethane coating has been applied.

13. The pants of claim 11 wherein from an outside view of the pants, the portion of the denim material with the polyurethane coating, the graduated edging, and a region of the denim material without the polyurethane coating as in the buttocks region, blend seamlessly together without any seam lines.

14. The pants of claim 11 wherein a width of the graduated edging is from about ½ inch (about 1.3 centimeters) to about 1 inch (about 2.5 centimeters).

15. The pants of claim 11 wherein in the graduated edging, regions with polyurethane coating and the open spaces are meshed together.

16. A pants comprising:

a denim material sewn into pants, wherein the denim material has a first stretch characteristic;

a polyurethane coating, applied to a portion of an inside of the denim material in an upper thigh region of the pants and avoiding a buttocks region, wherein the denim material with the polyurethane coating has a second stretch characteristic which is less elastic than the first stretch characteristic, and the polyurethane coating is not visible from an exterior of the pants; and a graduated edging to the polyurethane coating, wherein the graduated edging is positioned between a portion of the polyurethane coating comprising a solid polyurethane coating of solid fill without open spaces and the buttocks region of the pants, where the polyurethane coating is omitted, and the graduated edging comprises a polyurethane coating with a plurality of open spaces that reduces its fill density relative to the solid polyurethane coating, thereby avoiding an abrupt transition between the solid polyurethane coating and the buttocks region of the pants where the polyurethane coating is omitted.

17. The pants of claim 16 wherein in the graduated edging, the plurality of open spaces are embedded within the polyurethane coating.

18. The pants of claim 16 wherein from an outside view of the pants, the portion of the denim material with the polyurethane coating, the graduated edging, and a region of the denim material without the polyurethane coating as in the buttocks region, blend seamlessly together without any seam lines.

19. The pants of claim 16 wherein the denim material comprises cotton blended with spandex.

* * * * *